US005751405A

United States Patent [19]

Aita et al.

[11] Patent Number: 5,751,405

[45] Date of Patent: May 12, 1998

[54] IMAGE FORMING APPARATUS

[75] Inventors: Shuichi Aita; Tsutomu Kukimoto, both of Yokohama; Satoshi Yoshida, Tokyo; Yoshifumi Hano, Inagi, all of Japan

[73] Assignee: Canon Kabushiki Kaisha, Tokyo, Japan

[21] Appl. No.: 559,094

[22] Filed: Nov. 16, 1995

[30] Foreign Application Priority Data

Nov. 18, 1994 [JP] Japan ..... 6-285270
Nov. 1, 1995 [JP] Japan ..... 7-284993

[51] Int. Cl.[6] ..... G03G 15/06; G03G 15/24

[52] U.S. Cl. ..... 355/269; 355/219; 355/270

[58] Field of Search ..... 355/200, 210, 355/219, 245, 269, 270, 296, 298

[56] References Cited

U.S. PATENT DOCUMENTS

| | | | |
|---|---|---|---|
| 5,196,892 | 3/1993 | Mitsuaki | 355/269 |
| 5,294,961 | 3/1994 | Ohtaka et al. | 355/219 |
| 5,321,471 | 6/1994 | Ito et al. | 355/219 |
| 5,323,215 | 6/1994 | Ohtaka et al. | 355/269 |

FOREIGN PATENT DOCUMENTS

| | | |
|---|---|---|
| 59-133573 | 7/1984 | Japan . |
| 62-203182 | 3/1986 | Japan . |
| 63-133179 | 6/1988 | Japan . |
| 64-20587 | 1/1989 | Japan . |
| 2-51168 | 2/1990 | Japan . |
| 2-302772 | 12/1990 | Japan . |
| 5-2287 | 1/1993 | Japan . |
| 5-2289 | 1/1993 | Japan . |
| 5-53482 | 3/1993 | Japan . |
| 5-61383 | 3/1993 | Japan . |

*Primary Examiner*—Sandra L. Brase
*Attorney, Agent, or Firm*—Fitzpatrick, Cella, Harper & Scinto

[57] ABSTRACT

An image forming apparatus includes an image bearing member; developing-cleaning member for cleaning the image bearing member by removing residual toner from the image bearing member simultaneously with formation of a toner image by developing an electrostatic latent image formed on the image bearing member with toner having a charging polarity opposite from a charge polarity of the electrostatic latent image; transfer member for transferring the toner image from the image bearing member to a transfer material; and charging member for charging the toner remaining on the image bearing member after image transfer by the transfer member and before development by the developing-cleaning member to a polarity which is the same as the charging polarity of the toner image, and for charging the image bearing member to a polarity which is opposite from the charging polarity of the toner image.

16 Claims, 11 Drawing Sheets

IMAGE FORMING APPARATUS

FIELD OF THE INVENTION AND RELATED ART

The present invention relates to an image forming apparatus capable of cleaning an image bearing member such as a photosensitive member, while developing an image borne on the image bearing member. It is applicable to copying machines, printers, facsimiles, and the like.

There have been known a large number of image forming apparatuses employing an electro-photographic system. In the case of a conventional image forming apparatus, an electrostatic latent image is formed on a photosensitive member, which is composed of photoconductive material using various means, and the formed electrostatic image is developed with toner, being visualized as a toner image. Then, the toner image is transferred onto appropriate transfer material such as paper. The transferred image is fixed to the transfer material with the use of heat, pressure, and the like, producing a copy or a print. The residual toner left on the photosensitive member after the image transfer is removed therefrom in a cleaning step.

Conventionally, cleaning methods employing a blade, a fur brush, a roller, or the like have been used in the cleaning step. Any of these cleaning methods mechanically scrapes the residual toner into a waste toner container, or blocks the residual toner so that it falls into the waste toner container. In other words, the blade, fur brush, roller or the like is pressed on the surface of the photosensitive member, creating problems. For example, the photosensitive member is frictionally worn as the cleaning member is forced thereon, and as a result, the service life of the photosensitive member is shortened.

On the other hand, in terms of the recording apparatus, provision of the cleaning apparatus naturally increases the recording apparatus size, interfering with the effort to create a compact recording apparatus. Further, from an ecological point of view, and also in terms of efficient toner utilization, a system which does not generate waste toner has been desired.

For example, Japanese Laid-Open Patent Application Nos. 133,573/1984, 203,182/1987, 133,179/1988, 20,587/1989, 51,168/1990, 302,772/1990, 2,287/1993, 2,289/1993, 53,482/1993, 61,383/1993, and the like disclose the conventional art called concurrent (development parallel) cleaning system (or cleaner-less system).

However, the concurrent cleaning system such as the systems disclosed in these patent applications uses a reversal development process in which the charge polarities of the toner and photosensitive member are the same. Therefore, it is impossible in principle to apply the concurrent cleaning system to the conventional copying machines or the like, which are of the analog type and employ a regular development process.

Also, when a laser or an LED array is used as exposing means, it is impossible in principle to apply the conventional concurrent cleaning system to so-called "back scan", in which the area constituting the background is exposed.

Thus, such a concurrent cleaning system has been desired that is applicable to even a system employing the regular development process, in which the polarity of the toner charge is opposite to the polarity of the photosensitive member charge.

Accordingly, the primary object of the present invention is to provide an image forming apparatus, which employs the normal developing process, and is capable of carrying out the concurrent cleaning.

Another object of the present invention is to provide an image forming apparatus capable of preventing the shaving of an image bearing member.

Another object of the present invention is to provide a compact image forming apparatus.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
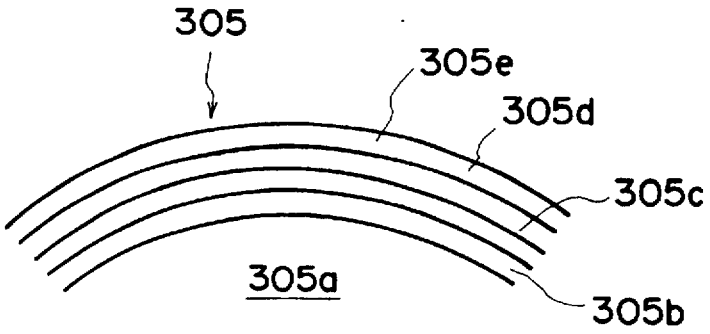
FIG. 1 is a partial cross-sectional view of a photosensitive member structure.

To begin with, a conventional system will be described, in comparison with an embodiment of the present invention, in order to explain why the reversal development process, in which the polarities of the toner charge, and photosensitive member charge, are the same.

When the concurrent cleaning system is employed along with the reversal development process, a DC current, or a bias comprising an AC component is applied to a development sleeve as a developer carrying member, during the development period, or pre- or postdevelopment standby period, and its potential is controlled so that the post-transfer residual toner on the photosensitive member can be recovered from the areas where the toner should not be present while image areas are developed. In this case, the essential factors are the amount of the toner of the photosensitive member, and the polarity, to which the toner on the photosensitive member is charged in each step of the electrophotographic process. For example, in the case of an electrophotographic process employing a photosensitive member with negative charge polarity, and toner with negative charge polarity, when a toner image is transferred onto the transfer material using transfer means with positive charge polarity, the charge polarity of the residual toner varies between the positive and negative sides, depending on the relationship among the applied voltage, aspects of the transfer material (difference in thickness, resistance, dielectric constant, or the like), image size, and the like.

However, when the photosensitive member chargeable to negative polarity is charged by the negative corona shower or negative discharge, not only is the photosensitive member surface uniformly charged, but also the residual toner is uniformly charged to the negative polarity even if the polarity the residual toner might have had shifted to the positive side during the transfer step. As a result, the residual toner having been charge to the negative polarity remains on the photosensitive member surface areas with a potential correspondent to the light portions of the original, to which the toner should not be adhered, but does not remain on the photosensitive member surface area with a potential correspondent to the dark portions of the original, to which the toner should not be adhered. This is because the toner on the areas with the dark portion potential is attracted toward the development sleeve as the toner carrier member due to the development electric field.

When a regular development process without modification is used with a photosensitive member with negative charge polarity, the toner with positive charge polarity is employed. In this case, however, the residual toner which enters a development station is entirely charged to the negative polarity while the photosensitive member is charged with the negative corona shower or discharge. Therefore, a phenomenon occurs in which the residual toner is removed from the dark portion, but remains on the white portion, producing an utterly useless image. In other words, conventionally speaking, the concurrent cleaning system is compatible only with the reversal development process.

After going through extensive research and development, the inventors of the present invention invented a concurrent cleaning system applicable even to the regular development process. Such a concurrent cleaning system was realized by inserting a charge controlling step, in which the charge was controlled by a contact or non-contact charging member as a secondary charging means, after a step in which primary charging means is used. Hereinafter, this concurrent cleaning system will be described.

One of the practical methods for charge control is to dispose a charge control member, in contact with, or immediately adjacent to, a photosensitive member charged to a desirable potential. As for the charge control member, a brush, a roller, a blade or the like, is employed, the resistance of which is in a low to medium range.

In other words, the following phenomenon is utilized; when the charge control member is present, after the photosensitive member is charged to Vd by the charging member, the surface potential of the photosensitive member changes due to the electrical discharge which occurs between the charge control member and photosensitive member surface. That is, while obtaining a necessary potential for the photosensitive member surface, a desirable charge polarity can be provided to the toner remaining on the surface of the photosensitive member, by selecting Vd and Vc with proper values.

According to the above mechanism, when a medium resistance member under potential control is used as the charge control member, electrical discharge occurs between the photosensitive member (surface potential Vd) and charge control member (applied voltage Vc) until the potential difference between the two members is reduced to an extinction voltage. The toner charge can be controlled by the charge control member when the following formula is satisfied, although the discharge extinction voltage is dependent on the thickness, dielectric constant, resistance, and the like, of the photosensitive member, as well as the resistance, dielectric constant, and the like, of the charge control member:

$$|Vd-Vc|>|Vth|$$

(Vth: discharge extinction voltage or discharge inception voltage)

However, when the regular development process is employed, the following formula must be satisfied in order to reverse only the toner polarity, without changing the polarity of the charge potential Vd of the photosensitive member, by the charge control member. It should be noted here that the potentials described in this embodiment are relative to the electrically conductive base portion of the photosensitive member.

$$|Vd|>|Vc|$$

In this case, after being subjected to the charge control by the charge control member, the potential of the photosensitive member is maintained at Vth+Vc, relative to the electrically conductive base portion of the photosensitive member, by the charge control member, which may be used as the dark area potential on the photosensitive member; whereas, the potential of the residual toner on the photosensitive member is reversed, relative to the polarity of the photosensitive member, making it possible to use the concurrent cleaning system together with the regular development process.

Figure 2:
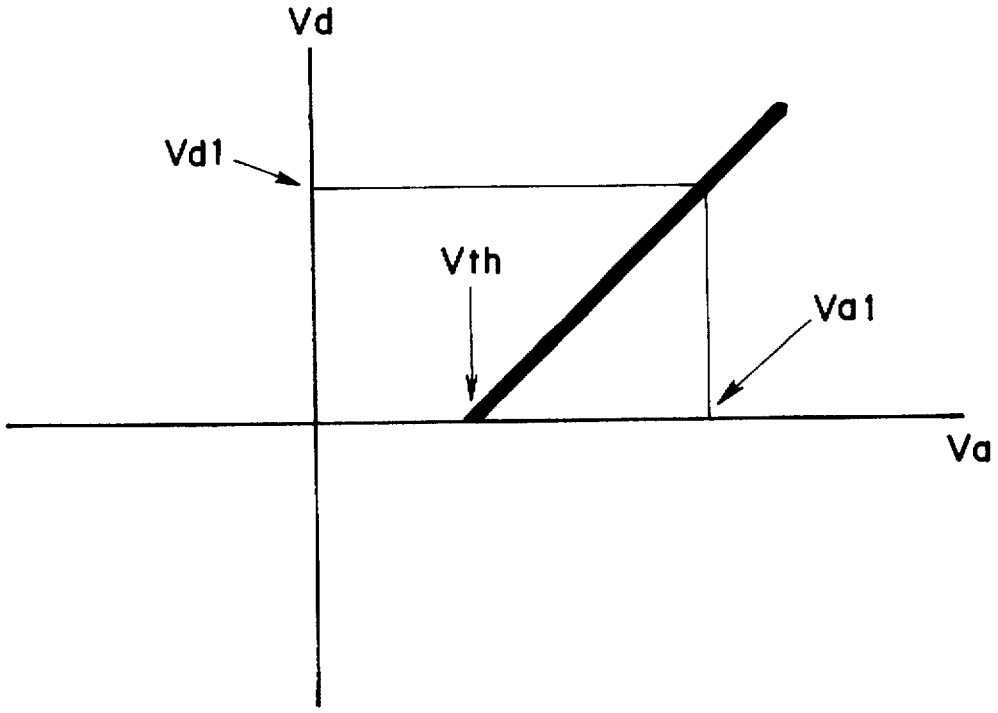
FIG. 2 is a graph showing the relationship between the voltage Va applied to a charge roller, and the potential Vd of the photosensitive member charge.
Figure 3:
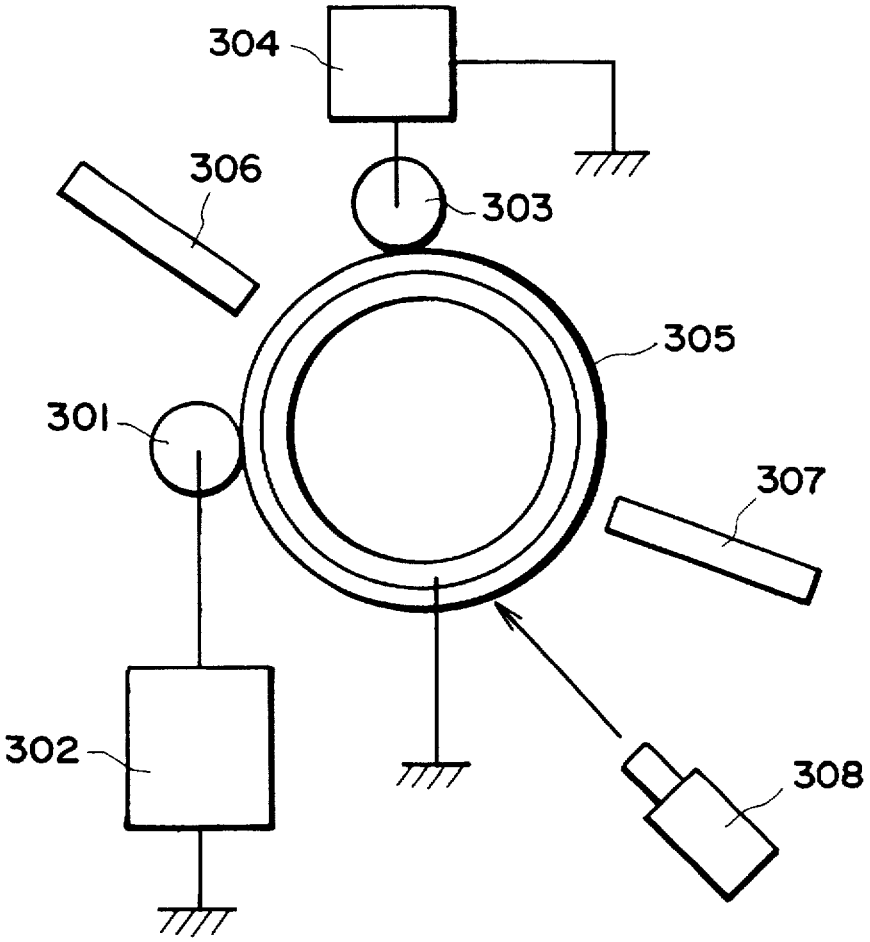
FIG. 3 is a schematic view of the essential portions of an electro-photographic apparatus.

The specifics of the aforementioned mechanism will be described with reference to FIGS. 2, 3 and 4.

A DC voltage Va is applied to the charge roller 301 as the first charging means by an electrical power source 302, whereby the surface of a photosensitive member 305 is uniformly charged (to a potential of Vd). Then a voltage Vc is applied to a charge control roller 303 as the second charging means by an electrical power source 304 connected to the charge control roller 303. The relationship, at this point, between the voltages (Va and Vc) applied by the power sources 302 and 304, and the potentials measured by an electrometer 306 and 307, will be described below.

First, the photosensitive member 305 is charged by the charge roller 301, and the potential of the charge is measured by the electrometer 306. FIG. 2 shows the characteristic of this charge. After the applied voltage Va exceeds the charge inception voltage Vth, the relationship between the applied voltage Va and potential Vd becomes linear, which is expressed by the following formula:

$$Vd=Va-Vth$$

When a DC voltage Va1 is applied to the charge roller 301, the potential of the photosensitive member 305 measured at the location of the electrometer 306 becomes Vd1.

Figure 4:
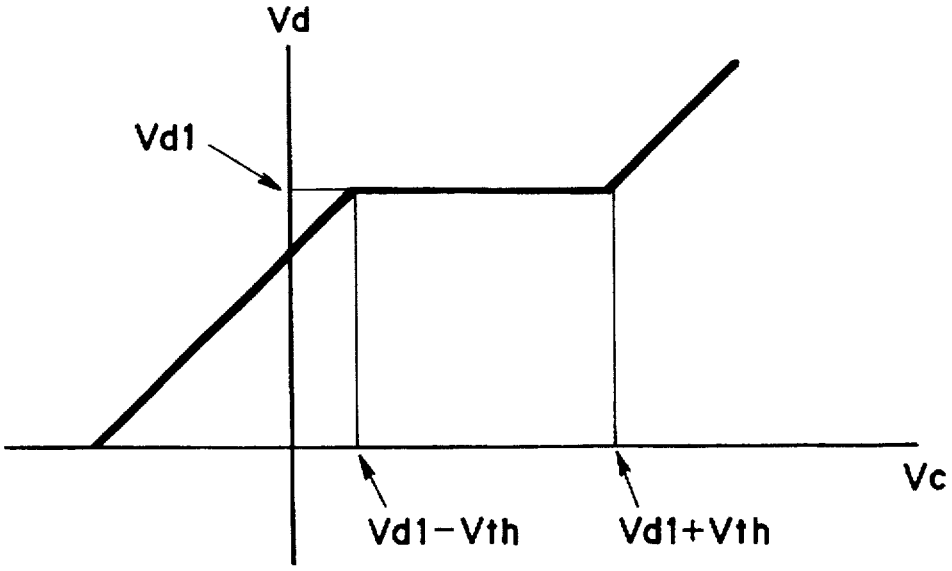
FIG. 4 is a graph showing the relationship between the voltage Vc applied to a charge controller roller, and the potential Vd of the photosensitive member charge.

FIG. 4 shows the potential Vd of the photosensitive member 305, which is detected by an electrometer 307 while changing the voltage Vc applied to a charge control member 303 disposed in a system with the above charge characteristic; an alphanumeric reference Va1 designates a voltage applied to the charge roller 301. As for the absolute value of the potential Vd of the photosensitive member 305, which is detected by the electrometer 307, it drops as the voltage Vc drops on the left side of a point (Vd1−Vth); does not change between the point (Vd1−Vth) and a point (Vd1+Vth); and further increases on the right side of the point (Vd1+Vth). In other words, only when a voltage difference of no less than Vth exists between the potential Vd1 given by the charge roller 301, and the voltage Vc applied to the charge roller 303, the discharge occurs between the photosensitive member 305 and charge roller 303, and changes the potential of the photosensitive member 305.

Referring to FIG. 4, it is evident that in the range on the left side of the point (Vd1−Vth), the absolute value of Vd is reduced by the charge control roller 303. In other words, it is conceivable that the photosensitive member 305 is subjected to a discharge, the polarity of which is reversal to the polarity of the voltage applied to the charging member, by the charge control roller 303, and this phenomenon controls the polarity of the residual toner on the photosensitive member; the discharge with the positive polarity controls the residual toner on the photosensitive member so that the charge polarity of the residual toner becomes reversal to the charge polarity of the photosensitive member 305. When Vc<Vd1−Vth, the potential of the photosensitive member 305 becomes (Vc+Vth) after the photosensitive member 305 is placed under the control of the charge roller 303. It should be noted here that the dielectric constants and resistances of the charge rollers 301 and 303 in this embodiment are rendered the same.

In the case of the method described above, the charge polarities of the photosensitive member and the residual toner thereon are controlled by two or more members. Therefore, the number of the power sources must match the number of the controlling members. However, because of the presence of the charge inception voltage Vth, the charge polarity of the toner left after a transfer step can be controlled by simply grounding the charge control member (Vc=0), which is the essential characteristic of this system. In other words, only a single power source is necessary even though two or more members are employed. As a result, this system enjoys merits in terms of cost. For example, when Vth is −500 V, the photosensitive member is charged initially to a potential of −700 V, and then, this potential of −700 V is adjusted to −500 V by the grounded charge roller 303.

As another example of the specific means, a corona discharge device may be employed as the first charging means, but in consideration of the fact that the corona discharge device generates ozone, and therefore requires an ozone filter, the preceding means, in which the charging device as the first charging means is placed in contact with the photosensitive member, can be said to be a preferable means. Further, the charge roller 303 may be replaced with a charging member which is disposed immediately adjacent to the photosensitive member, without contact. In such a case, the gap between the charging member and photosensitive member is preferred to be no more than 500 μm.

There is no specific limitation with respect to the type of development process to which the present invention is applicable, but those processes in which the developer on a development sleeve as the developer carrying member is in contact with the surface of the photosensitive member may be preferably used. When the magnetic brush development process is employed along with two component developer, ferrite, magnetite, iron powder, or the like, is used as a carrier; they may be coated with acrylic resin, silicone resin, fluorinated resin, or the like. In this case, the potential difference between the photosensitive member and development sleeve is controlled by applying a DC current, or a bias comprising an AC component, to the development sleeve, in such a manner that during the development process, or during the pre- or postdevelopment process, the toner is not transferred from the development sleeve to the photosensitive member surface areas, to which the toner must not be adhered, but the residual toner is recovered from the photosensitive member surface by the development sleeve.

The essential factors in this process are the polarity and amount of the toner charge on the photosensitive member, in each step of the electrophotographic process. For example, when an image visualized by a transferring means with negative polarity is transferred onto the transfer material, in the transfer step of an electro-photographic process employing a photosensitive member with negative charge polarity, and toner with positive charge polarity, the polarity of the residual toner changes from positive to negative, depending on the relationship among the applied voltage, aspects of the transfer material (thickness, resistance, dielectric constant, and the like).

However, when the photosensitive member with negative charge polarity is charged with the first charging means, not only the surface of the photosensitive member, but also the residual toner, the polarity of which might have remained positive after the transfer step, are uniformly charged to the negative polarity by the corona shower, or discharge, with negative polarity. According to the present invention, the surface potential of the photosensitive member is controlled with the charge control member as the second charging means in such a manner that the surface potential of the photosensitive member is adjusted to, and maintained at, a desirable level of the negative potential, even though the polarity of this residual toner, which has been uniformly charged to the negative polarity, is changed to the positive side. The desirable level of the negative potential for the photosensitive member in this case is such a level at which the post-transfer residual toner on the area with a potential level correspondent to the dark portions of an original is charged to the positive side and remains thereon, where the toner should be adhered, but the post-transfer residual toner on the area correspondent to the light portions of the original, where the toner should not be adhered, is attracted to the toner carrying member due to a development electrical field, and does not remain thereon.

The present invention is also applicable to the single component magnetic, or nonmagnetic, developer. In this case, the toner is coated on a metallic sleeve, a coated sleeve, an elastic roller, or the like, and is placed immediately adjacent to the photosensitive member surface, with a microscopic gap, or placed in contact with the photosensitive member surface. To the developer carrier member, a DC current or an AC voltage is applied. In this case, it is essential that a force is generated to pull the toner away from the photosensitive member surface, from the area which the toner should not be adhered, whether or not the toner is magnetic.

Further, the present invention is applicable to another type of development process, in which a single component developer (toner), which is coated on the surface of an elastic roller or the like, is placed in contact with the photosensitive member surface. In this case, the concurrent cleaning is carried out by the electric field maintained between the photosensitive member, and the elastic roller placed in contact with the photosensitive member surface, with the interposition of the toner; therefore, it is necessary that a certain level of potential is maintained on, or immediately below, the surface of the elastic roller, in order for the electric field to be generated in the narrow gap between the surfaces of the photosensitive member, and elastic roller as the toner carrier member. This is accomplished by controlling the elastic rubber of the elastic roller so that its resistance falls within an intermediate resistance range in order to impede the current flow between the photosensitive member and elastic roller, or by placing a thin layer of electrically insulating material on the surface of an electrically conductive roller. Further, an electrically conductive roller may be covered with an electrically conductive resin sleeve. The surface of the electrically conductive roller, which faces the photosensitive member, is coated with electrically insulating material, or may be covered with an electrically insulating sleeve, and the surface of the photosensitive member, which faces away from the photosensitive member, is provided with an electrically conductive layer.

When a contact development process employing a single component developer is used, the roller surface, on which the toner is carried, and the photosensitive member surface, may move in the same direction or in the opposite direction. When they move in the same direction, the ratio of the roller surface velocity to the photosensitive member surface velocity is preferably no less than 100%. When it is below 100%, image quality deteriorates. The higher the aforementioned surface velocity ratio is, the more the amount of the toner supplied to the development station is, increasing the frequency at which the toner is adhered or removed from the latent image. In other words, the frequency at which the toner is scraped off from where it should not be adhered, and is adhered where it should be, is increased to produce an image true to the latent image.

From the viewpoint of the concurrent cleaning, the following effect can be expected; the post-transfer residual toner clinging to the photosensitive member is mechanically detached from the photosensitive member due to the surface velocity difference between the photosensitive member and development roller, and then, the detached residual toner is recovered by the electrical field. Therefore, the higher the peripheral velocity ratio is, the more preferable it is for recovering the residual toner.

Next, the structures, materials, and production methods, of the charging member as the first charging means, and charge control member as the second charging means, will be described with reference to examples.

When the charging members are in the form of a roller or a blade, they are formed of metallic material such as iron, copper, stainless steel, or the like, or resin or like material, in which carbon, metal, metallic oxide, or the like, is dispersed. They may be in the form of a rod or a plate.

As for the structure of the elastic roller, it comprises: an electrically conductive base portion; and an elastic layer, an electrically conductive layer, and a resistive layer, which are laminated on the base portion. As for the material for the elastic layer of the roller, the following are available: rubber or sponge materials such as chloroprene rubber, isoprene rubber, EPDM rubber, polyurethane rubber, epoxy rubber, and butyl rubber; and thermoplastic elastomers such as thermoplastic styrene-butadiene elastomer, thermoplastic polyurethane elastomer, thermoplastic polyester elastomer, thermoplastic ethylene-vinyl acetate elastomer, and the like. As for the electrically conductive layer, materials with a volumetric resistivity of no more than $10^7$ Ω·cm, preferably, no more than $10^6$ Ω·cm, are employed; for example, a thin film of deposited metal, resin in which electrically conductive particles are dispersed, electrically conductive resin, or the like. More specifically, as the thin film of deposited metal, it is possible to list deposited films of aluminum, indium, nickel, copper, iron, or the like, and as the resin in which electrically conductive material is dispersed, it is possible to list urethane, polyester, vinyl acetate-vinyl chloride copolymer, and polymethyl methacrylate, in which the electrically conductive particles of carbon, aluminum, nickel, titanium oxide, or the like, are dispersed.

As the electrically conductive resin, it is possible to list polymethyl methacrylate containing fourth-class ammonium salt, polyvinyl aniline, polyvinyl pyrrole, polydiacetylene, polyethyleneimine, and the like. The resistive layer is a layer with a volumetric resistivity of $10^6$–$10^{12}$ Ω·cm, and semiconductive resin, electrically insulating resin, in which electrically conductive particles or the like are dispersed, can be employed. As the semiconductive resin, ethyl cellulose, nitrocellulose, methoxyl methyl nylon, ethoxyl methyl nylon, copolymer nylon, polyvinyl hydrin, casein, and the like can be employed. As the resins in which the electrically conductive particles are dispersed, it is possible to list electrically insulating resins, such as urethane, polyester, vinyl ether-vinyl chloride copolymer, or polymethyl methacrylate, in which particles of electrically conductive material, such as carbon, aluminum, indium oxide, titanium oxide, or the like, are dispersed.

When a brush is used as the charge control member, electrically conductive material is dispersed in commonly used brush fiber to adjust the resistance. In this case, commonly known fibers may be employed; for example, nylon fiber, acrylic fiber, rayon fiber, polycarbonate fiber, and polyester fiber.

As for the electrically conductive material, commonly known electrically conductive materials may be employed: for example, metal such as copper, nickel, iron, aluminum, gold, and silver; metallic oxide such as ferrous oxide, zinc oxide, tin oxide, antimony oxide, and titanium oxide; and electrically conductive powder such as carbon black. The particles of these electrically conductive materials may be subjected to surface treatments, as needed, to give them hydrophobicity or to adjust their electrical resistance. When selecting the electrically conductive material, dispersibility in the fiber material and productivity should be taken into consideration. As for the specifications of the brush, it is preferable that the thickness of the fiber is 1–20 denier (fiber diameter: 10–500 μm); fiber length, 1–15 mm; and fiber density is 10,000–300,000 strands per square inch ($1.5\times10^7/m^2$–$4.5\times10^8/m^2$).

According to one of the desirable aspects of the present invention, the surface of the photosensitive member is provided with mold release properties. Therefore, the amount of the post-transfer residual toner can be greatly reduced, which makes it possible to create a system in which the development process hardly suffers from the ill effects of the light blocking residual toner.

The present invention is effectively applicable when the photosensitive member surface is mainly composed of high polymer binder; for example, when mainly resin material is used for forming a protective film on a photosensitive member formed of inorganic material such as selenium or amorphous silicon; when an organic photosensitive member with divided functions is provided with a surface layer, as a charge transfer layer, composed of charge transfer material and resin; or when the aforementioned protective layer is formed on the surface of the organic photosensitive member with divided functions. As for means for giving mold release properties to the surface layers described above, there are the following methods:

(1) a method which forms the film using only resin with low surface energy.

(2) a method which adds additives to give water repellency and lipophilic properties, and (3) a method which disperses material having high degree of mold release properties, in the form of powder.

For example, in the case of (1), radicals containing fluorine, radicals containing silicon, or the like, are inserted into the resin structure. In the case of (2), surfactant or the like is used as the additive. In the case of (3), the powder of fluorinated compound, such as polytetrafluoroethylene, polyfluorovinylidene, and fluorocarbon, can be listed. Among them, polytetrafluoroethylene is particularly preferable. In the present invention, it is preferable to disperse the mold releasing powder of fluorinated resin of (3).

A photosensitive member having the surface layer containing these powders can be produced just by forming the outermost layer using binder resin in which these powders are dispersed. In the case of an organic photosensitive member, which is composed of mainly resin material, it is unnecessary to form a separate surface layer; all that is necessary is to disperse the powder in the peripheral portion of the organic photosensitive member.

As for the amount of the powder to be added in the surface layer, it is preferable to be within a range of 1–60 wt %, more preferably, 2–50 wt %, relative to the total weight of the surface layer. When the amount of the additive is no more than 1 wt %, the residual toner is not satisfactorily reduced. In other words, the residual toner cleaning efficiency is not satisfactory, failing to effectively eliminate ghosts. When the amount of the additive exceeds 60 wt %, the film strength is reduced, and also, the amount of light allowed to penetrate into the photosensitive member is extremely reduced, which is not preferable. As for the particle diameter of the powder, it is preferable to be no more than 1 μm, more preferably, no more than 0.5 μm, in consideration of image quality. When the particle diameter is no less than 1 μm, the light entering the photosensitive member is scattered, deteriorating the sharpness of edges. Therefore, the particle diameter no less than 1 μm is not suitable for practical application.

Next, a preferable embodiment of the photosensitive member 305 in accordance with the present invention will be described with reference to FIG. 1.

The conductive base 305*a* is in the form of a cylinder or film, which is formed of metal such as aluminum or stainless steel, plastic, or paper. When plastic or paper is employed, its outward facing surface is covered with an electrically conductive layer 305*b* of aluminum alloy, indium-tin oxide alloy, or the like; or plastic comprising electrically conductive polymer is employed. When paper or plastic is employed, it may be impregnated with electrically conductive particles.

On the electrically conductive base 305*a*, an undercoat layer 305*c* may be laid to improve the adhesiveness or coating properties of a photosensitive layer, to protect the base 305*a*, to cover up the imperfections of the base 305*a*, to facilitate the charge injection from the base 305*a*, to protect the photosensitive layer from electrical damages, etc. The undercoat layer 305*c* is composed of polyvinyl alcohol, poly-N-vinylimidezole, polyethylene oxide, ethyl cellulose, methyl cellulose, nitrocellulose, ethylene, acrylic copolymer, polyvinyl butyral, phenol resin, casein, polyamide, coplymer nylon, animal glue, gelatin, polyurethane, aluminium oxide, or the like. Its film thickness is generally set be in a range of 0.1–10.0 μm, preferably, 0.1–3.0 μm.

The charge generating layer 305*d* is formed by coating an appropriate bonding agent in which a charge generating material is dispersed, by depositing it, or by the like means. In this case, the charge generating material is azo pigment, phthalocyanine pigment, indigoid pigment, perylene pigment, polycyclic quinone pigment, SUKUWARILIUM dye, pyrylium salts, thio-pyrylium salts, triphenylmethane dye, selenium, noncrystalline silicon, or the like. The bonding agent can be selected from a wide range of bonding resins: polycarbonate resin, polyester resin, polyvinyl butyral resin, polystyrene resin, acrylic resin, methacrylic resin, phenol resin, silicon resin, epoxy resin, polyvinyl acetate resin, or the like. The amount of the bonding agent in the charge generating layer 305*d* should be set to be no more than 80 wt %, preferably, 0–40 wt %. As for the thickness of the charge generating layer 305*d*, it should be set to be no more than 5.00 μm, preferably, 0.05–2.00 μm.

The function of the charge generating layer 305*e* is to receive charge carriers from the charge generating layer 305*d*, and transfer them. This charge transfer layer 305*e* is formed by dissolving charge transfer material, along with a bonding resin if necessary, into a solvent, and coating the solution. Its thickness is generally set within a range of 5–40 μm. As for the charge transfer material, there are: polycyclic aromatic compounds, which contains biphenylene, anthracene, pyrene, phenanthrene, and the like, in the principle or side chain; cyclic compounds such as indole, carbazole, oxadiazole, pyrazoline, and the like; and also, hydrazone compound, styryl compound, selenium, selenium-tellurium, noncrystalline silicon, cadmium sulfide, and the like.

As for the bonding resins in which these charge transfer materials are dispersed, there are: resins such as polycarbonate resin, polyester resin, polymethacrylate, polystyrene resin, acrylic resin, polyamide resin; and photoconductive organic polymers such as poly-N vinyl carbazole or poly vinyl anthracene.

The polarity of the photosensitive member may be either positive or negative. When the photosensitive member is a laminated type member chargeable to positive polarity, the layers are accumulated in the order of the charge generating layer, and the charge transfer layer composed of an electron carrier compound; or the layers may be accumulated in the order of the charge transfer layer composed of a hole carrier compound, and the charge generating layer. The same layer structures are also applicable to a photosensitive member chargeable to negative charge polarity.

Further, a protective resin layer may be formed as a surface layer. As for the protective layer resin, there are polyester, polycarbonate, acrylic resin, epoxy resin, phenol resin, and the like. These resins are employed alone, in combination with a hardening agent, or in combination of two or more, and their hardening agents.

Further, fine particles of an electrically conductive material may be dispersed in the protective layer resin. The examples of such electrically conductive materials are metals, metallic oxides, and the like. More specifically, microparticles of the following are preferable: zinc oxide, titanium oxide, tin oxide, antimony oxide, indium oxide, bismuth oxide, titanium oxide coated with tin oxide, indium oxide coated with tin, tin oxide coated with antimony, zirconium oxide, and the like. These materials may be employed alone or in a mixture of two or more. Generally speaking, when the particles are dispersed in the protective layer, the particle diameter should be smaller than the wavelength of the incident light in order to prevent the incident light from being scattered by the dispersed particles. Therefore, the diameter of the particle dispersed in the protective layer in accordance with the present invention is preferred to be no more than 0.5 μm. The particle content in the protective layer is preferred to be in a range of 2–90 wt % relative to the total weight of the protective layer, more preferably, in a range of 5–80 wt %. The thickness of the protective layer is preferred to be 0.1–10.0 μm, more preferably, 1.0–7.0 μm.

The surface layer may be formed by coating solution in which resin is dispersed, using spray coating, beam coating, or dip coating.

According to the present invention, it is preferable that micropowder is present on the surface of the toner particle.

As for such micropowder, the following may be employed: colloidal silica, titanium oxide, ferrous oxide, aluminium oxide, magnesium oxide, calcium titanate, barium titanate, strontium titanate, magnesium titanate, celium oxide, zirconium oxide, and the like. These materials may be employed alone or in a mixture of two or more.

As for the bonding agent for the toner in accordance with the present invention, a wide range of well-known toner bonding resins may be employed alone, or in combinations of two or more; for example, styrene resin, polyester resin, acrylic resin, phenol resin, epoxy resin, and the like.

As for coloring agents, well-known inorganic or organic dyes, or inorganic or organic pigments, may be used; for example, carbon black, aniline black, acetylene black, Naphthol Yellow, Hanza Yellow, Rhodamine Lake, Alizarin Lake, red iron oxide, phthalocyanine blue, indanthrene blue, and the like. Normally, 0.5–20 parts of the coloring agent are used per 100 parts of the bonding agent.

Further, nigrosine dye, fourth class ammonium salt, complex metallic salicylates, metallic salts, acetyl acetone, or the like may be used to control the charge.

The toner in accordance with the present invention may be produced by a known method. For example, a bonding resin, wax, metallic salt or complex metallic salt, pigment as the coloring agent, dye, magnetic material, charge control agent as needed, and other additives, are thoroughly mixed using a fixer such as a Henschel mixer or a ball mill. The mixture is melted and kneaded using a heated kneading machine such as a heat roller, a kneader, or extruder. Then, the metallic compounds, pigment, dye, magnetic material, are dispersed or dissolved into the preceding melted mixture. After cooling, the solidified mixture is pulverized and classified to obtain desirable toner.

According to the present invention, the toner polarity may be either positive or negative. Also, the toner may be composed of either a single or two components, and may be either magnetic or nonmagnetic. However, it is essential that the polarity of the toner is selected so as to become reverse to the charge polarity of the photosensitive member.

Hereinafter, the embodiments of the present invention will be described with reference to the drawings.

Example 1 of photosensitive member production method

As for the base 305*a* of the photosensitive member 305, an aluminium cylinder was employed, the diameter ϕ was 30 mm, and the length of which was 254 mm. On this base 305*a*, the structural layers 305*b*–305*e* as shown in FIG. 1 were sequentially accumulated by the dip coating, to finish the photosensitive member 305.

(1) Electrically conductive coat layer: mainly phenol resin in which tin oxide or titanium oxide powder is dispersed; thickness: 15 μ.

(2) Undercoat layer 305*c*: mainly denatured nylon, and copolymer nylon; Thickness: 0.6 μm (3) Charge generating layer 305*d*: mainly butyral resin in which titanyl phthalocyanine pigment capable of absorbing long wave is dispersed; thickness: 0.6 μm.

(4) Charge transfer layer 305*e*: mainly polycarbonate resin (molecular weight measured by Oswald viscosity method: 20,000) in which triphenyl compound is dissolved at a weight ratio of 8:1, and also, polytetrafluoroethylene powder (particle diameter: 0.2 μm) is uniformly dispersed by 10 wt % relative to the overall solid contents; thickness: 25 μm; and contact angle relative to water: 95°.

The contact angle was measured using pure water. As for the measuring apparatus, a contact angle meter CA-DS, a product of Kyoowa Surface Science Inc. was used.

Example 2 of photosensitive member production method

The photosensitive member was produced using the same method as Embodiment 2, except that polytetrafluoroethylen was not added. The contact angle relative to water was 74°.

Example of developer production

| | |
|---|---|
| styrene-acrylic resin | 79 wt % |
| styrene-butadiene resin | 10 wt % |
| nigrosine dye | 2 wt % |
| carbon black | 5 wt % |
| polyolefine | 4 wt % |

After the above ingredients were mixed, the obtained mixture was kneaded with a biaxial kneading extruder. The obtained kneaded mixture was cooled, pulverized with an pneumatic pulverizer, and then classified with a multiclass classifier to obtain a toner compound with adjusted grain size distribution. Then, microparticles of cationic hydrophobic silica (BET 200 $m^2/g$) was added to the toner by 1.5 wt %, producing the toner in the final form, with a weight average particle diameter of 8.2 μm.

Embodiment 1

A laser beam printer (Canon LBP-860) was prepared as an electrophotographic apparatus. Its process speed was 47 mm/sec.

The charging member of the process cartridge of the LPB-860 employed a roller. The rubber cleaning blade of this process cartridge was removed, and a roller was fitted in the location from which the blade was removed. The roller which had been in the apparatus was used as the charge control roller as the second charging means, and the newly attached roller was used as the charge roller as the first charging means.

Figure 5:
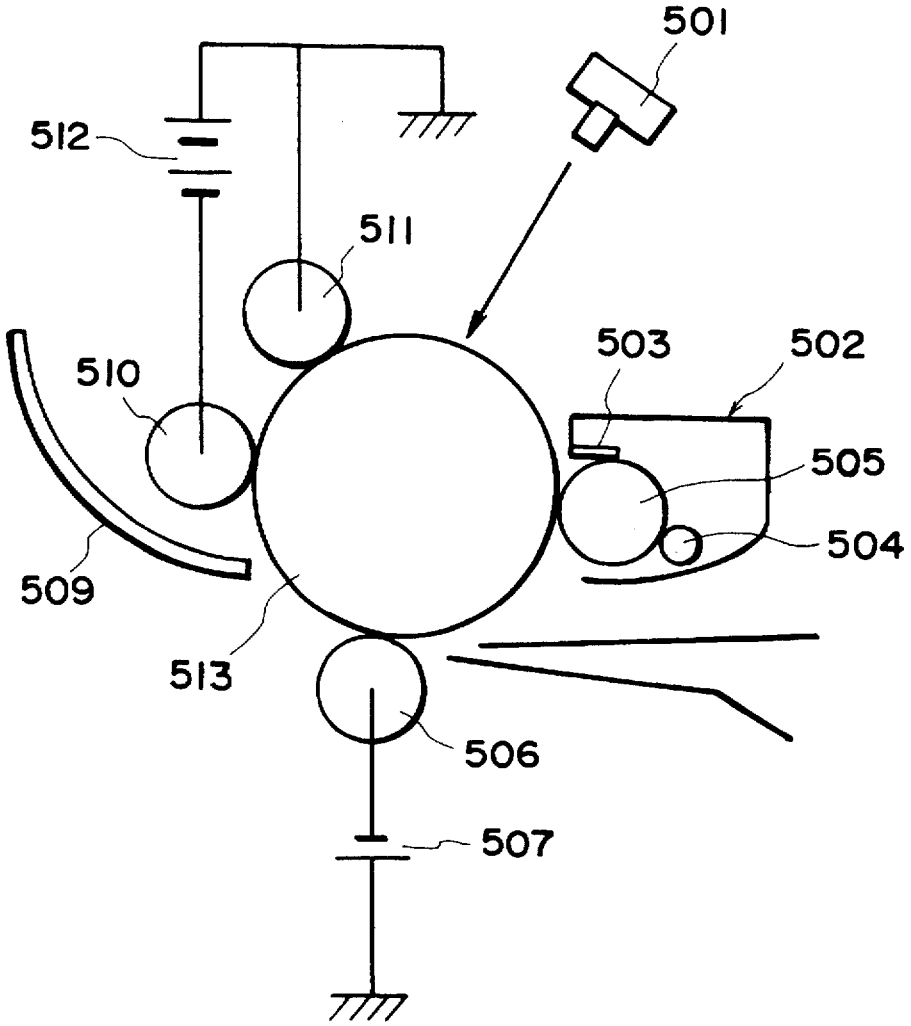
FIG. 5 is a schematic view of the essential portions of another electro-photographic apparatus.

Next, referring to FIG. 5, an optical fiber 509 was disposed at a predetermined location between the transfer member 506 and charge member 511, to expose the photosensitive member 513, before the photosensitive member was charged, and to expose the photosensitive member 513, on the areas correspondent to the non-image portion of the original, after the potentials of the toner and photosensitive member 513 were controlled.

Next, the development station of the process cartridge was modified; the stainless steel sleeve, which was the toner delivery member, was replaced with a foamed urethane rubber roller (18 mm in diameter) with a medium electrical resistance, as a toner carrier member 505, and this toner carrier member 505 was placed in contact with the photosensitive member 513. The rotational directions of the toner carrier member 505 and photosensitive member 513 were the same at the contact point, and the toner carrier member 505 was driven at a rotational velocity, which was 150% of the rotational velocity of the photosensitive member 513.

As means for coating the toner on the toner carrier member 505, a coater roller 504 was disposed in. the developing station 502, in contact with the toner carrier member 505. Further, in order to regulate the toner layer coated on the toner carrier member 505, a stainless blade coated with a resin material was mounted.

Referring to FIG. 5 again, a reference numeral 501 designate a laser beam-based image exposure unit; 502, a developing device; 504, a toner supply roller; 506, a transfer roller; and 507 designates a transfer power source.

A voltage Va from the power source 512 was applied to the photosensitive member 513 by the charge roller 510, whereby the surface of the photosensitive member 513 was uniformly charged (to a potential of Vd). Next, a grounded charge control roller 511 was disposed to follow the charge roller 510. It can be assumed that the charge control roller 511 was connected to the a power source with 0 V. The relationship between the voltage Va from the power source 512, and the potential Vd of the photosensitive member, on the area within the developing station, at that time, is shown in FIGS. 6 and 7.

Figure 6:
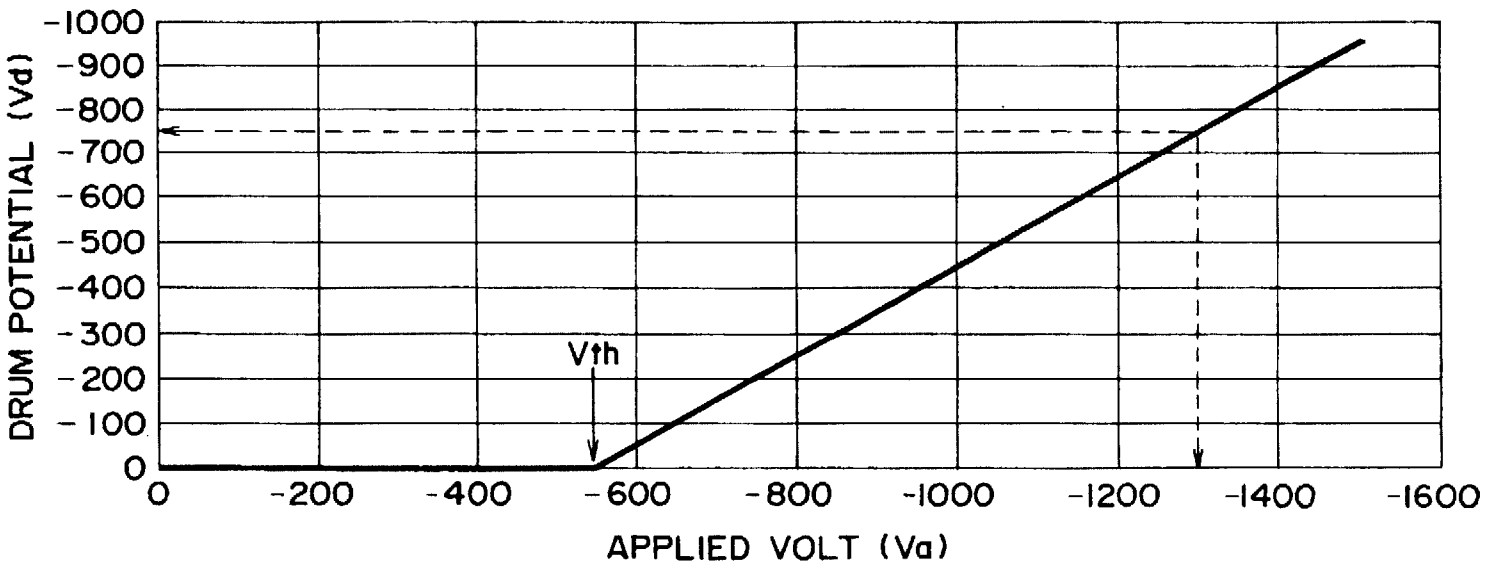
FIG. 6 is a graph showing the charge characteristic of a photosensitive member.
Figure 7:
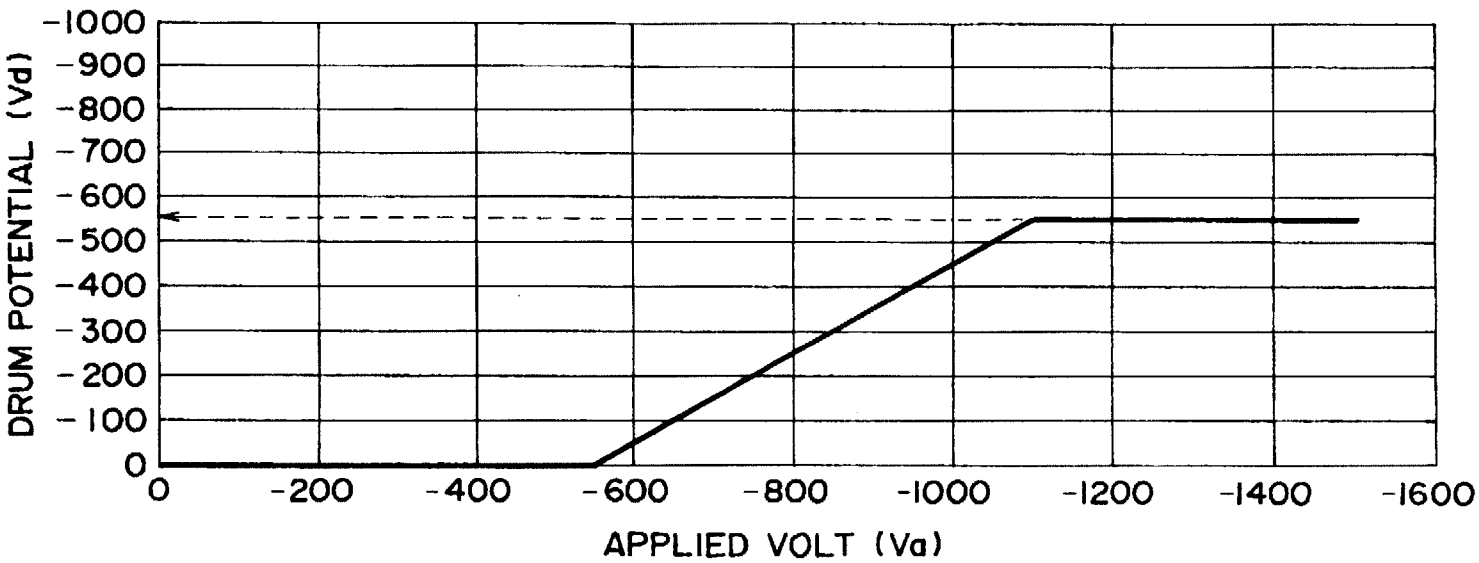
FIG. 7 is a graph showing the charge characteristic of another photosensitive member.

FIG. 6 shows the charge characteristic of the photosensitive member 513 which was charged by the charge roller 510 after the toner charge control roller 511 was removed. When the applied voltage Va exceeded a charge starting voltage Vth, a charge characteristic linear to the applied voltage Va was obtained, and the following relationship was present between the applied voltage Va and charge potential Vd.

$$Vd=Va-Vth$$

(Vths of charge roller and charge control roller were −500 V)

FIG. 7 shows the charge characteristic, that is, the charge potential Vd, of the photosensitive member 513 in a different system, in which the grounded charge control roller 511 (its voltage was regulated to 0 V) was added.

The characteristic was as follows:

When the voltage VA applied to charge roller 510 satisfies:

$$|Va|>2\times|Vth|$$

$$Vd=Vth$$

This was the condition under which the stable dark area correspondent potential was obtained, and at the same time, the charge polarity of the post-transfer residual toner could be rendered reverse to the charge polarity of the photosensitive member.

Further, the following formula was satisfied:

$$|Vd1-Vc|>|Vth|,\ |Vd1>|Vc|$$

(Vc: voltage applied to the charge control roller 511 to render the polarity of the post-transfer residual toner reverse to the polarity of the photosensitive member by the charge control member 511 as described above); Vd1: potential of the photosensitive member charged by the charge roller 510)

Also, in order to reliably reverse the polarity of the post-transfer residual toner relative to the polarity of the photosensitive member, it is desirable to satisfy the following condition:

$$|Vd1|>|Vd1-Vth|\geqq 50$$

Figure 8:
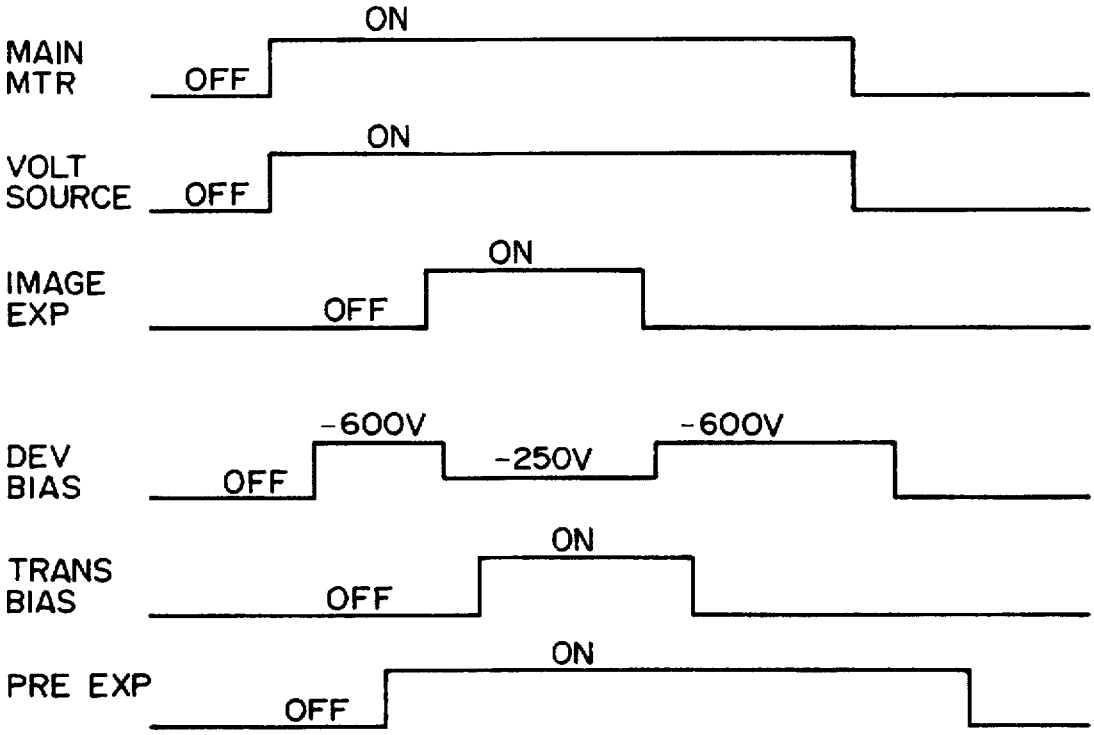
FIG. 8 is a process sequence diagram.

Further, the electro-photographic apparatus was modified to accommodate the modifications of the process cartridge, and the processing conditions were also set accordingly. In addition, the processing sequence was changed as shown in FIG. 8 so that the regular development process could be managed.

In the modified apparatus, images were recorded through a process comprising: a step in which the photosensitive member was charged with the charge roller as the first charging means; a step in which the polarity of all the post-transfer residual toner was rendered reverse to the polarity of the photosensitive member; a step in which the area correspondent to the background portions of the original was exposed to the laser beam (backscan) to form an electrostatic latent image; a step in which this electrostatic latent image was visualized as a toner image; and a step in which this toner image was transferred onto transfer material by the roller to which a voltage was applied.

The photosensitive member 513 was made using Example 1 of the photosensitive member production method, and the toner as the developer was produced using the aforementioned example of the developer production method. After −1,300 V was applied to the photosensitive member by the charge roller 510, the potential of the photosensitive member 513 was controlled so that the potential correspondent to the dark area became −500 V, and the potential correspondent to the light area became −50 V. The development bias was a DC current with a voltage of −250 V.

The produced images were evaluated using a predetermined test pattern, in which a pattern formed of black and white parallel stripes having a length equivalent to the circumference of the photosensitive member, was followed by a half tone generating pattern formed of one dot lateral lines and two dot lateral lines appearing alternately. As for the transfer material, plain paper with a basis of 75 g/m$^2$, cardboard with a basis of 130 g/m$^2$, and film sheet for an overhead projector, were used.

Figure 10:
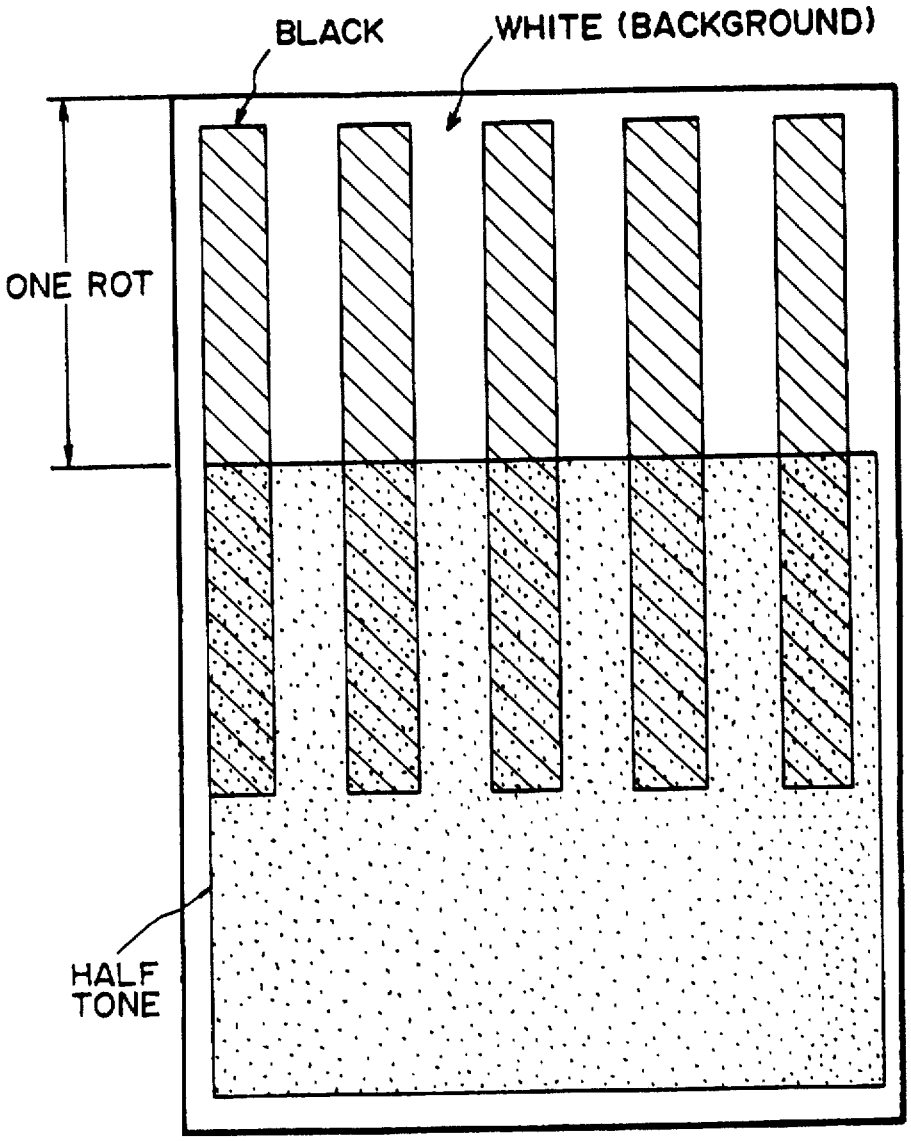
FIG. 10 is an image pattern for evaluating a ghost.

A conceptual drawing of a ghost evaluation pattern is given in FIG. 10. The evaluation was made in the following manner. The reflection density was measured at two locations of a single print by a Macbeth illuminometer. Both locations were in the print portion formed by the second rotation of the photosensitive member, one of which corresponds to where a black image was formed in the print portion (black print portion) formed by the first rotation of the photosensitive member, and the other of which corresponds to where no black image was formed (background portion) in the print portion formed by the first rotation of the photosensitive member. Then, the evaluation was made on the basis of difference in reflection density between the two locations. In the case of this embodiment, the reflection density was measured by a Macbeth illuminometer.

reflection density difference=reflection density of the location correspondent to where the image was formed—reflection density of the location correspondent to where no image was formed The smaller the reflection density difference is, the better the ghost level is.

Other image evaluations made beside the above evaluation were also favorable; image quality was preferable with respect to image density, fog, and the like.

The overall results are summed up in Table 1.

TABLE 1

| | Embobiment 1 | Embodiment 2 | Embodiment 3 | Embodiment 4 |
|---|---|---|---|---|
| Image density | 1.42 | 1.41 | 1.4 | 1.34 |
| Fog | 1.4 | 1.6 | 1.7 | 1.5 |
| Ghost | | | | |
| 75 g/m$^2$ paper | 0 | 0 | 0 | 0 |
| 130 g/m$^2$ paper | −0.01 | −0.03 | −0.02 | −0.03 |
| OHP film | −0.01 | −0.05 | −0.04 | −0.05 |
| | Comp.Ex. 1 | Comp.Ex. 2 | Comp.Ex. 3 | Comp.Ex. 4 |
| Image density | 1.04 | 1.04 | 0.99 | 1.06 |
| Fog | 31.4 | 45.3 | 40.1 | 36.8 |
| Ghost | | | | |
| 75 g/m$^2$ paper | Image disturbance | Image disturbance | Image disturbance | Image disturbance |
| 130 g/m$^2$ paper | Image disturbanae | Image disturbance | Image disturbance | Image disturbance |
| OHP film | Image disturbance | Image disturbance | Image disturbance | Image disturbance |

The amount of the fog was measured using a reflection type illuminometer (Reflectometer: model TC-6S, product of Tokyo Denshoku Co., Ltd.). More specifically, the reflection densities of the white area of a finished copy (worst value being Ds), and the surface of a white sheet prior to printing (average reflection density value being Dr), were measured, and the amount of the fog was defined as (Ds-Dr). Practically speaking, when the amount of the fog in an image is no more than 2%, the image may be considered as a preferable fog-free image, and when it exceeds 5%, the image becomes an undesirable one with conspicuous foggy appearance.

Comparative Example 1

This example was the same as Embodiment 1, except that the toner charge control roller 511 was eliminated, and was subjected to the same evaluations as those made in Embodiment 1. In case of this example, the fog was generated over the entire print surface, rendering the print absolutely unusable. Regarding the ghost, the image was so seriously disturbed that it did not warrant measuring.

Embodiment 2

The electro-photographic apparatus used in this embodiment was the same as the one used in Embodiment 1.

In place of the photosensitive member charging roller 510, and charge control roller 511, of the process cartridge employed in Embodiment 1, fixed brushes 910 and 911 were mounted, respectively, and a power source was connected to the charge control brushes. The schematic view of the structure is given in FIG. 9.

The photosensitive member 914 was made using Example 2 of the photosensitive member production method, and the developer was produced using the aforementioned example of the developer production method. When the charge brush 910 was used, the Vth of the photosensitive member 914 was −500 V.

The image evaluation was made in the same manner as Embodiment 1, in which the voltage of a power source 912 was 1,200 V; the voltage of a power source 913, 0 V; and the development bias was a DC current with a voltage of −250 V. Further, the dark portion potential was −500 V, and the light portion potential was −50 V. The results of the evaluations are given in Table 1.

Figure 9:
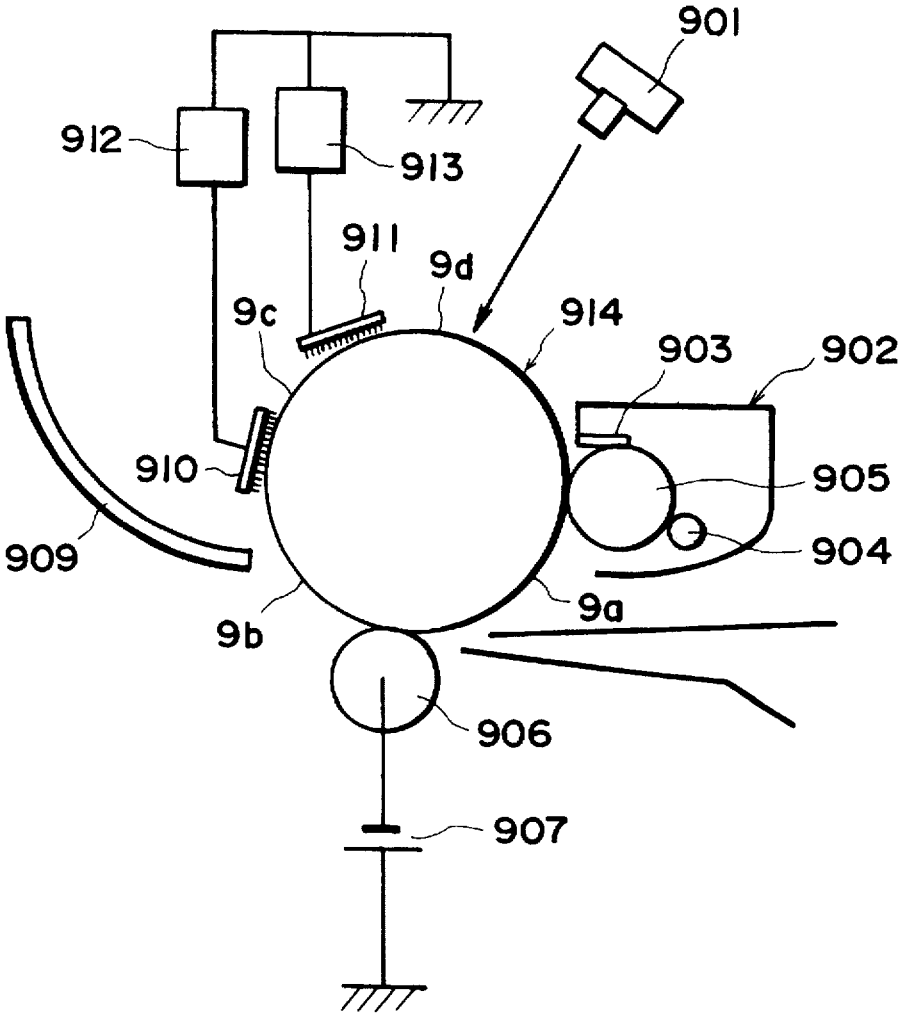
FIG. 9 is a schematic view of the essential portions of another electro-photographic apparatus.

Referring to FIG. 9, in order to examine the effects of the toner potential control, the photosensitive member polarity and toner polarity were checked at points 9*a*, 9*b*, 9*c* and 9*d*. The results are given in Table 2. As is evident from Table 2, the polarity of the post-transfer residual toner could be rendered reverse to the polarity of the photosensitive member by allowing electrical discharge to occur between the photosensitive member, which had been charged to a potential of −700 V by the brush 910, and the brush 911, so that the potential of the photosensitive member could be shifted toward the positive polarity side. Therefore, the condition for employing the concurrent cleaning method together with the regular development process was satisfied.

Also referring to FIG. 9, a reference numeral 901 designates a laser-based exposure unit; 902, a development device; 903, a stainless blade coated with resin; 904, a toner supply roller; 905, a development roller; 906, a transfer roller; 907, a transfer power source; 909, a precharge exposure optical fiber; and 911 designates a charge control brush.

TABLE 2

| | EMB. 2 | EMB. 3 | EMB. 4 | COMPEx. 2 | COMPEx 3 | COMPEX. 4 |
|---|---|---|---|---|---|---|
| V of 912 (V) | −1200 | −1200 | −1200 | −1200 | −1200 | −1200 |
| V of 913 (V) | 0 | −100 | +100 | −1200 | −800 | −400 |
| Pot. at 9c (V) | −700 | −700 | −700 | −700 | −700 | −700 |
| Pot. at 9d (V) | −500 | −600 | −400 | −700 | −700 | −700 |
| Dev. bias (V) | −250 | −300 | −200 | −300 | −300 | −300 |
| Trans. V (V) | −2800 | −2800 | −2800 | −2800 | −2800 | −2800 |
| Toner 9a | + | + | + | + | + | + |
| Toner 9b | − | − | − | − | − | − |
| Toner 9c | − | − | − | − | − | − |
| Toner 9d | + | + | + | − | − | − |

Embodiment '

This embodiment was the same as Embodiment 2, except that the voltage of the power source 913 and development bias were changed to −100 V and −300 V, respectively. The same evaluation as Embodiment 2 was made. The dark portion potential was −600 V, and the light portion potential was −50 V. The results are given in Table 1.

Referring to FIG. 9, in order to examine the effects of the toner potential control, the photosensitive member polarity and toner polarity were checked at points 9*a*, 9*b*, 9*c* and 9*d*. The results are given in Table 2. As is evident from Table 2, the polarity of the post-transfer residual toner could be rendered reverse to the polarity of the photosensitive member. In other words, the condition for employing the concurrent cleaning method together with the regular development process was satisfied.

Embodiment 4

This embodiment was also the same as Embodiment 2, except that the voltages of the power source 913 and development bias were changed to +100 V and −200 V.

respectively. The same evaluation as Embodiment 2 was made. The dark portion potential was −400 V, and the light portion potential was −50 V. The results are given in Table 1.

Referring to 9, in order to examine the effects of the toner potential control, the photosensitive member polarity and toner polarity were checked at points 9*a*, 9*b*, 9*c* and 9*d*. The results are given in Table 2. As is evident from Table 2, the polarity of the post-transfer residual toner could be rendered reverse to the polarity of the photosensitive member. In other words, the condition for employing the concurrent cleaning method together with the regular development process was satisfied.

Comparative Example 2

This example was the same as Embodiment 2, except that the voltages of the power source 913 and development bias were changed to −1,200 V and −300 V, respectively. It was evaluated in the same manner as Embodiment 2. The dark portion potential was −700 V, and the light portion potential was −50 V.

Referring to 9, in order to examine the effects of the toner potential control, the photosensitive member polarity and toner polarity were checked at points 9*a*, 9*b*, 9*c* and 9*d*. The results are given in Table 2. As is evident from Table 2, the polarity of the post-transfer residual toner could not be rendered reverse to the polarity of the photosensitive member. In other words, the condition for employing the concurrent cleaning method together with the regular development process could not be satisfied.

The values of the actually measured image density and amount of the fog are given in Table 1. The image density was low, and the amount of the fog was large, resulting in an image not suitable for practical usage. As regards the evaluation of ghost, the image disturbance was too excessive to warrant measurement.

Comparative Example 3

This example was the same as Embodiment 2, except that the voltages for the power source 913 and development bias were changed to −800 V and −300 V, respectively. It was evaluated in the same manner as Embodiment 2. The dark portion potential was −700 V, and the light portion potential was −50 V.

Referring to 9, in order to examine the effects of the toner potential control, the photosensitive member polarity and toner polarity were checked at points 9*a*, 9*b*, 9*c* and 9*d*. The results are given in Table 2. As is evident from Table 2, the polarity of the post-transfer residual toner could not be rendered reverse to the polarity of the photosensitive member. In other words, the condition for employing the concurrent cleaning method together with the regular development process could not be satisfied.

The values of the actually measured image density and amount of the fog are given in Table 1. The image density was low, and the amount of the fog was large, resulting in an image not suitable for practical usage. As regards the evaluation of ghost, the image disturbance was too excessive to warrant measurement.

Comparative Example 4

This example was the same as Embodiment 2, except that the voltages for the power source 913 and development bias were changed to −400 V and −300 V, respectively. It was evaluated in the same manner as Embodiment 2. The dark portion potential was −700 V, and the light portion potential was −50 V.

Referring to 9, in order to examine the effects of the toner potential control, the photosensitive member polarity and toner polarity were checked at points 9*a*, 9*b*, 9*c* and 9*d*. The results are given in Table 2. As is evident from Table 2, the polarity of the post-transfer residual toner could not be rendered reverse to the polarity of the photosensitive member. In other words, the condition for employing the concurrent cleaning method together with the regular development process could not be satisfied.

The values of the actually measured image density and amount of the fog are given in Table 1. The image density was low, and the amount of the fog was large, resulting in an image not suitable for practical usage. As regards the evaluation of ghost, the image disturbance was too excessive to warrant measurement.

As is evident from the embodiments described above, according to the present invention, the contact or noncontact type charge control member is disposed between the charge member and exposure member; therefore, the concurrent cleaning method can be applied to even an image forming apparatus employing the regular development process.

Next, another embodiment will be described, in which after the post-transfer residual toner is charged to the polarity reverse to the polarity of the photosensitive member by the first charging means, the potential of the photosensitive member is reversed to the same polarity as the charge polarity of the photosensitive member by the second charging means, while allowing the polarity of the residual toner to be reversal to the charge polarity of the photosensitive member.

As the result of research, the inventors of the present invention discovered that when a voltage comprising an AC component and a DC component was applied to the charge member as the second charging means, the residual toner could pass by the charging location of the second charging means, maintaining the same charge polarity, regardless of the polarity of the DC component. In this case, the magnitude of the peak-to-peak voltage of the AC component was no less than twice the charge inception voltage Vth. Further, when the magnitude of the peak-to-peak voltage of the AC component was no less than twice Vth, the photosensitive member could be more uniformly charged than when it was no more than twice Vth or when only a DC voltage was employed. Also, the charge potential was not affected by the environment; the charge potential was stabilized at substantially the same level as the DC component.

Figure 11:
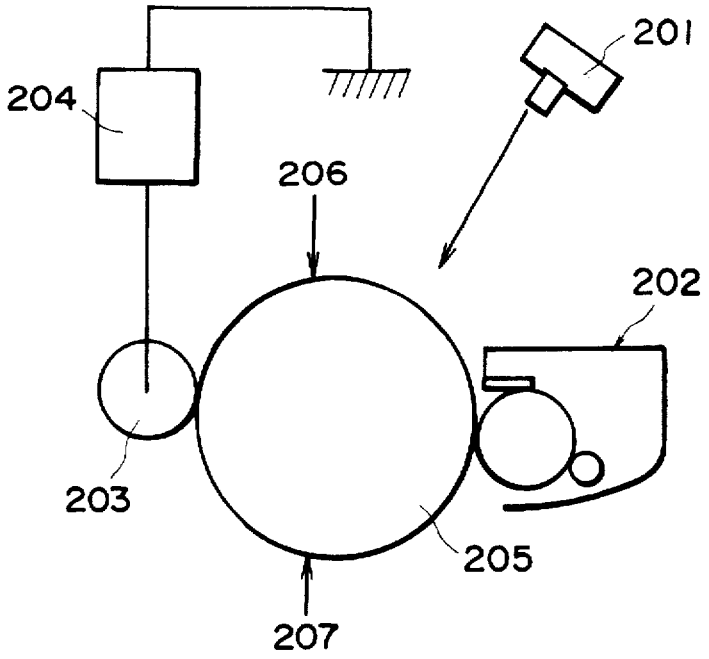
FIG. 11 is a schematic view of an apparatus to be used for evaluating the characteristic of the toner charge.

The above embodiment will be described with reference to FIG. 11.

The potential of the photosensitive member 205 is kept close to 0 V by exposing the photosensitive member surface with an exposing means, and the toner is adhered to the surface of this photosensitive member 205 with the near-zero voltage. When the adhered toner enters the charging location of a charge roller 203, a voltage is applied to the charge roller 203 by a voltage applying means 204, and the photosensitive member potential and and toner charge polarity are checked at a check point 1 (point indicated by an arrow 207 in FIG. 11) and a check point 2 (point indicated by an arrow 206).

Tables 3 and 4 shows the results obtained while varying the toner polarity, photosensitive member polarity, and voltage application method.

TABLE 3

| | | | | |
|---|---|---|---|---|
| Toner polarity (Dev. zone) | + | + | − | − |
| DC | + | − | − | + |
| Pot. (at 1) | + | − | − | + |
| Pot. (at 2) | 0 | 0 | 0 | 0 |
| Toner (at 1) | + | − | − | + |
| Toner (at 2) | + | + | − | − |

TABLE 4

| | | | | |
|---|---|---|---|---|
| Toner polarity (Dev. zone) | + | + | − | − |
| DC polarity (DC + AC) | + | − | − | + |
| | + | − | − | + |
| Pot. (at 1) | | | | |
| Pot. (at 2) | 0 | 0 | 0 | 0 |
| Toner (at 1) | + | + | − | − |
| Toner (at 2) | + | + | − | − |

Referring to Table 3, it is clear that when only a DC current is applied, the toner polarity checked (at check point 1) immediately after it was charged by a roller 203 followed the polarity of the applied DC current. Next, referring to Table 4, in the case of a system employing an AC superposed DC, the toner polarity remained the same, under all conditions, as immediately after it was charged by the roller 103.

In other words, the concurrent cleaning method was realized by employing, as the second charging means, a charge member, to which a voltage comprising a DC component and an AC component was applied, wherein the toner polarity of the post-transfer residual toner on the photosensitive member was changed to a desired polarity before the surface of the photosensitive member was charged to a desirable potential by the second charging means.

One specific means for charging the photosensitive member surface to a desirable potential is to dispose a charge control member in contact with, or immediately adjacent to, a photosensitive member charged to a desirable potential by the first charging means. The charge control member may be in the form of a brush, a roller, a blade, or the like, which has a medium range electrical resistance. Also, a corona-based charging device such as a COROTRON or a SCOROTRON may be employed as the charging means for the photosensitive member.

As described before, when a voltage comprising a DC component and an AC component is applied to the second charging means, the second charging means functions not only to charge the photosensitive member to a polarity reverse to the toner polarity, while maintaining the same toner polarity, but also to charge the photosensitive member surface more uniformly, to prevent the residual toner from being charged up during the development process, improving thereby the cleaning efficiency, and resultantly, preventing the occurrence of the fog, and the deterioration of image density, during the development process. This is because when the post-transfer residual toner, the charge of which was controlled by the first charging means, is captured during the development process, without being subjected to the charge by the second charging means, the toner with a higher potential is mixed into the developing device, firmly adhering to a triboelectric charging member or a toner delivery member, and consequently adversely affecting the triboelectrical charging efficiency and toner delivery, which is liable to cause fog, or density deterioration. This phenomenon is particularly conspicuous in a low humidity environment.

According to the image forming method in this embodiment, the step for charging the photosensitive member by the second charging means, and the step for controlling the toner by the first charging means, are separated; therefore, both steps can be independently controlled. In other words, the potential of the toner charge on the photosensitive member is minimally affected by the second charging means; therefore, the potential of the post-transfer residual toner charge can be preferably controlled in the toner charge control, so that the toner charge-up, which occurs during the development step, can be effectively prevented.

The development system to be employed in the following embodiments may be any development system described above.

As for the first and second charging means to be employed in the following embodiments, a charge member to be disposed close to a photosensitive member is employed, in addition to those charging means described above.

As for the charge member to be disposed immediately adjacent to the photosensitive member, a member comprising a strip of electrically conductive plate, and a resistive layer applied thereto, may be employed besides the aforementioned roller, blade, brush, and the like. The preferable resistance range of the resistive layer is from $10^5$ Ω/cm to $10^{10}$ Ω/cm. The gap between this member and the photosensitive member should be 50 μm to 500 μm, preferably, no more than 300 μm. When the gap exceeds 500 μm, an extremely high voltage is required to control the toner charge or to charge the photosensitive member.

For example, the discharge inception voltage of a gap can be obtained using the following approximation formula derived from Paschen's law:

$$Vth \text{ (discharge inception voltage)}=312+6.2d \text{ (gap)}$$

According to this formula, when the gap is 100 μm, the discharge inception voltage is 932 V; when the gap is 200 μm, it is 1552 V; when the gap is 300 μm, it is 2172 V; and when the gap is 500 μm, it is 3412 V.

Such a resistive layer may be formed of one of the aforementioned materials listed with regard to the rollers. Further, various resins such as polyester, polyurethane, nylon, acrylic, polyolefine, and the like, in which metal such as copper, nickel, iron, aluminium, gold, silver, or the like, metallic oxide such as iron oxide, zinc oxide, tin oxide, antimony oxide, titanium oxide, or the like, or electrically conductive powder such as carbon black or the like, is dispersed, may be employed.

The photosensitive member and toner used in the embodiments, which will be described below, may be the same as those described above.

Embodiment 5

A laser beam printer (LBP–860, Canon) was prepared as the electrophotographic apparatus. Its process speed was 47 mm/sec.

The process cartridge for the LBP–860 employed a roller as the charge member. The cleaning rubber blade of this process cartridge was removed, and a roller was mounted at the location where the rubber blade had been. The roller which had been in the apparatus was used as the charge roller as the second charging means, and the newly mounted roller was the charge control roller as the first charging means.

Figure 12:
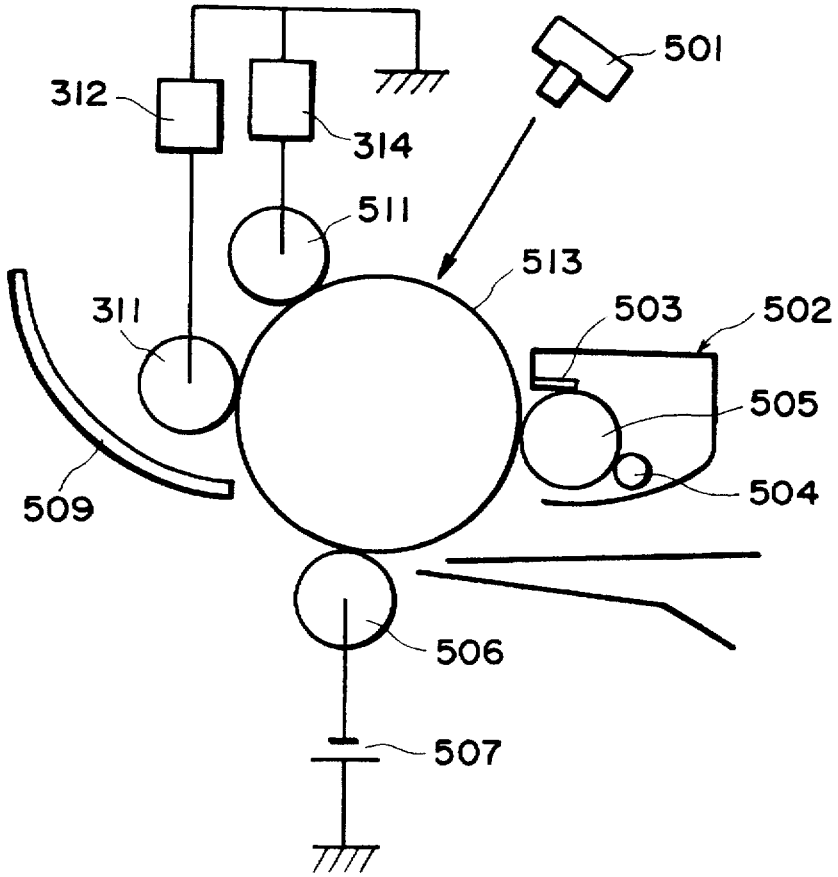
FIG. 12 is a schematic view of the essential portions of another electro-photographic apparatus.

Referring to FIG. 12, an optical fiber 509 was disposed between the transfer member and the photosensitive member charge member in order to expose the photosensitive member before it was charged.

Also, the development station of the process cartridge was modified; a stainless steel sleeve was replaced with a foamed urethane rubber roller, as a toner carrier member, with an electrically resistance of a medium range. This urethane rubber roller was placed in contact with the photosensitive member. The moving direction of the toner carrier member at its contact point with the photosensitive member 313 was the same as the photosensitive member. The toner carrier member was driven at 150% of the peripheral velocity of the photosensitive member.

As for means for coating the toner on the toner carrier member 505, a coating roller 504 was disposed in contact with the toner carrier member 505, in the developing station 502. Further, in order to regulate the toner coat layer on the toner carrier member 505, a stainless steel blade 503 coated with resin was mounted in the development station.

Following the optical fiber 509 relative to the rotational direction of the photosensitive member, a charge control roller 311 was disposed, and thereafter, a charge roller 511 was disposed. With this arrangement, after the potential of the photosensitive member surface was reduced to a voltage Vr by the optical fiber exposure, the potentials and polarities of the photosensitive member and post-transfer residual toner were controlled by the charge control roller 311, to which a voltage Va was applied by a power source 312, and thereafter, the photosensitive member was charged by the charge roller 511, to which an oscillating voltage comprising an AC component and a DC component was applied. Further, the electro-photographic apparatus and the process conditions were modified to accommodate the modified process cartridge.

In the case of the modified apparatus, the image bearing member was uniformly charged with the charge roller 511 after the polarity of all the post-transfer residual toner on the photosensitive member was rendered reverse to the polarity of the photosensitive member. Then, the area of the photosensitive member correspondent to the background portion of the original image (backscan) was exposed to a laser to form an electrostatic latent image. The latent image was visualized, as a toner image, with the toner, and the toner image was transferred to transfer material by the roller to which a voltage was applied.

correspondent to the light portion, using the charge control roller 311, to which −800 V was applied, and the charge roller 511, to which a voltage comprising a DC component having a voltage of −500 V, and an AC component having a peak-to-peak voltage of 2,000 V, was applied. The development bias was a DC current with a voltage of −250 V. The potential Vr of the photosensitive member potential Vr after the exposure by the optical fiber 509 was −50 V.

The produced images were evaluated using a predetermined test pattern, in which a pattern formed of black and white parallel stripes having a length equivalent to the circumference of the photosensitive member, was followed by a half tone generating pattern formed of two types of alternating lines, one of which was a simple horizontal single-dot line, and the other of which was a horizontal single-dot line comprising two blank spaces for every three dot locations. As for the transfer material, plain paper with a basis of 75 g/m$^2$, cardboard with a basis of 130 g/m$^2$, and film for an overhead projector, were used.

A conceptual drawing of a ghost evaluation pattern is given in FIG. 10. The evaluation was made on the basis of the difference in reflection density between two spots on a single print. More specifically, both spots were on the image portion formed by the second rotation of the photosensitive member, one spot was correspondent to the black image area (black print portion) of the image portion formed by the first rotation of the photosensitive member, and the other spot was correspondent to the area with no image (no print portion) of the image portion formed by the first rotation of the photosensitive member. The reflection density was measured with a Macbeth illuminometer, and the reflection density difference was obtained from the following formula:

reflection density difference=reflection density of a spot correspondent to where the image was formed−reflection density of a spot correspondent to where no image was formed The smaller the reflection density difference is, the better the ghost level is.

Other image evaluations made beside the above evaluation were also favorable; image quality was preferable with respect to image density, fog, and the like.

The overall results are summed up in Table 5.

TABLE 5

| | EMB.5 | EMB.6 | | | EMB.7 | | | | EMB. 8 | | | COMP.EX.5 | COMP.EX.6 |
|---|---|---|---|---|---|---|---|---|---|---|---|---|---|
| V to 311 | +800 | +900 | +700 | +1000 | +800 | +600 | +550 | +1000 | +800 | +600 | +550 | No MBR | +450 |
| Image density | 1.14 | 1.39 | 1.4 | 1.41 | 1.42 | 1.42 | 1.42 | 1.41 | 1.43 | 1.42 | 1.43 | 0.78 | 1.01 |
| Fog | 1.3 | 1.4 | 1.3 | 1.3 | 1.4 | 1.3 | 1.3 | 1.1 | 1.2 | 1.3 | 1.2 | 59.4 | 35.4 |
| Ghost | | | | | | | | | | | | | |
| 75 g/m$^2$ paper | 0 | 0 | 0 | 0 | 0 | 0 | 0 | 0 | 0 | 0 | 0 | Image disturbance | Image disturbance |
| 130 g/m$^2$ paper | 0 | 0 | 0 | 0 | 0 | 0 | 0 | 0 | 0 | 0 | 0 | Image disturbance | Image disturbance |
| OHP film | 0 | 0 | 0 | 0.01 | 0.01 | 0.01 | 0.01 | 0 | 0 | 0 | 0 | Image disturbance | Image disturbance |

The photosensitive member was made using Example 1 of the photosensitive member production method, and the toner was produced using the aforementioned example of the developer production method. The potential of the photosensitive member potential was set at −500 V in the areas correspondent to the dark portion, and −100 V in the area The amount of the fog was measured using a reflection type illuminometer (Reflectometer: model TC-6S, product of Tokyo Denshoku Co., Ltd.). More specifically, the reflection densities of the white area of a finished copy (worst value being Ds), and the surface of a white sheet prior to printing (average reflection density value being Dr), were measured, and the amount of the fog was defined as (Ds-Dr). Practically speaking, when the amount of the fog in an image is no more than 2%, the image may be considered as a preferable fog-free image, and when it exceeds 5%, the image becomes an undesirable one with a conspicuously foggy appearance.

Comparative Example 5

This example was the same as Embodiment 5, except that the toner charge control roller 311 was eliminated, and was subjected to the same evaluations as those made in Embodiment 5. In case of this example, fog was generated over the entire print surface, rendering the print absolutely unusable. As regards the ghost, the image was so seriously disturbed that it did not warrant measuring.

Embodiment 6

This embodiment is the same as Embodiment 5, except that the voltage applied to the charge control roller 311 was changed to −900 V, and −700 V. The results are summed up in Table 3.

Embodiment 7

This embodiment is also the same as Embodiment 5, except that, the voltage applied to the charge control member 311 was changed to +450 V. Since the difference between the charge control roller potential and photosensitive member surface potential (−50 V after precharge exposure) was less than the discharge inception voltage (550 V), the charge of the residual toner was not controlled, creating fog over the entire image area, and consequently, rendering the copy absolutely unsuitable for practical usage. As regards ghost, the image was so disturbed that it not deserve measuring.

Embodiment 8

Figure 13:
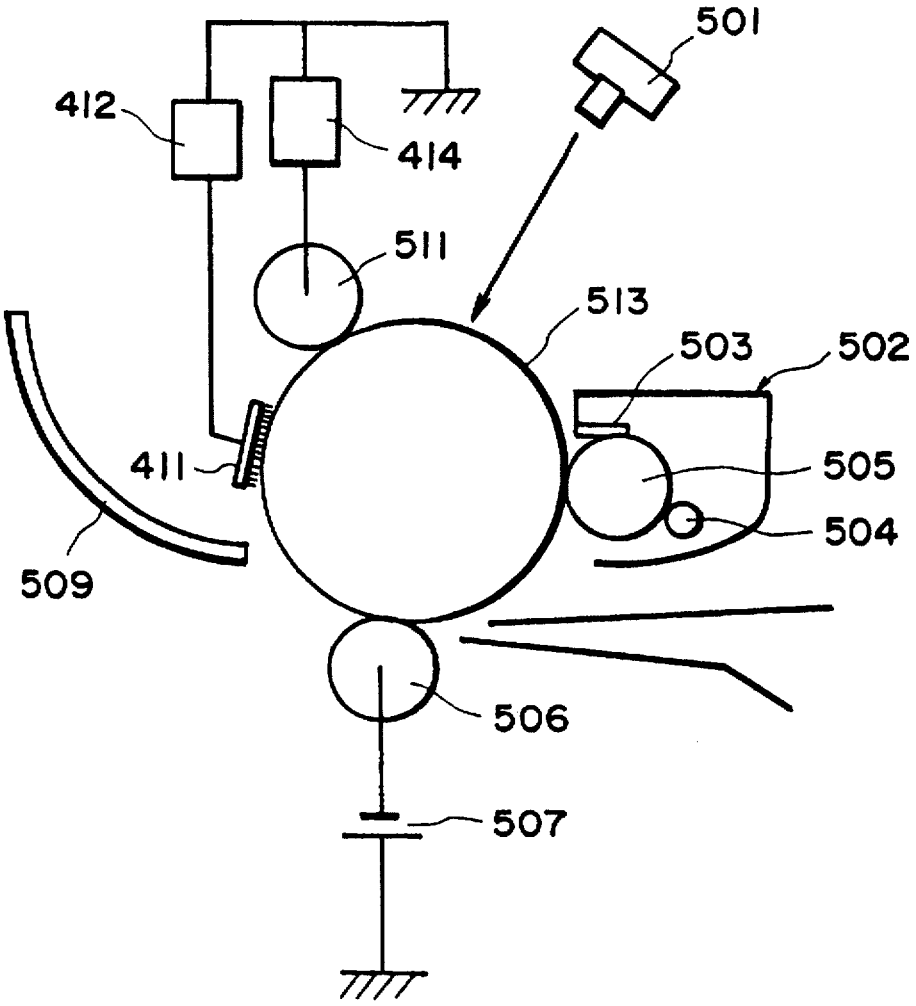
FIG. 13 is a schematic view of the essential portions of another electro-photographic apparatus.

The electro-photographic apparatus used in this embodiment was the same as the one used in Embodiment 5, except that in place of the charge control roller 311, of the process cartridge employed in Embodiment 5, fixed brush 411 was mounted, and a power source was connected to the charge control brush 411. The schematic view of the structure is given in FIG. 13.

The photosensitive member was made using Example 2 of the photosensitive member production method, and the developer was produced using the Example 1 of the developer production method. The image evaluation was made in the same manner as Embodiment 5, except that the voltage of the power source 412 was +1,000 V; a power source 413 provided a voltage comprising a DC component having a voltage of −500 V, and an AC component being superposed thereon and having a peak-to-peak voltage of 1,800 V; and the development bias was a DC current with a voltage of −250 V. Further, the dark portion potential was −500 V, and the light portion potential was −100 V. The results of the evaluations are given in Table 6.

When the fixed brush 411 was used to charge the photosensitive member made using Example 2 of the photosensitive member production method, the discharge inception voltage was 550 V.

Further, more tests were conducted by varying the voltage applied to the fixed brush to +800 V, +600 V, and +550 V, all of which produced preferable images.

Embodiment 9

The electro-photographic apparatus used in this embodiment was the same as the one used in Embodiment 5.

Figure 14:
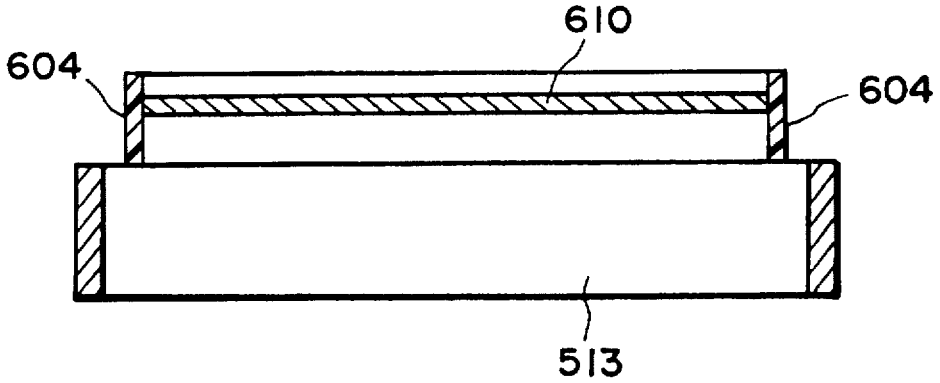
FIG. 14 is a side view of the charging member illustrated in FIG. 13.
Figure 15:
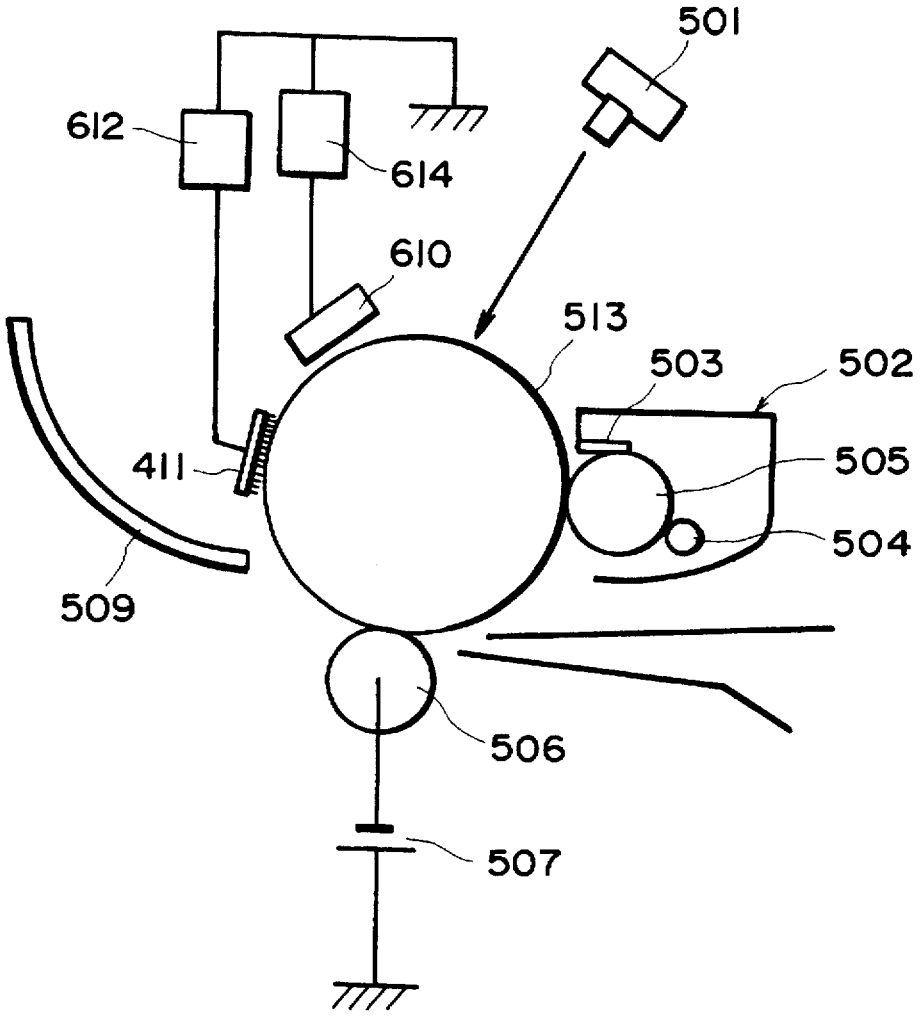
FIG. 15 is a schematic view of the essential portions of another electro-photographic apparatus.

In place of the charge roller 311 of the process cartridge employed in Embodiment 5, a plate-like member 610 shown in FIG. 14 was mounted using a spacer member 604 of polyacetal resin, which supports the plate-like member 610 to provide a gap of 100 μm between the plate-like member and photosensitive member. Further, a power source was connected to the charge control brush. The schematic view of this arrangement is given in FIG. 15.

The plate-like member 610 was constituted of a piece of plane parallel stainless steel plate, and a 500 μm thick sheet of nylon dispersively containing iron oxide, which were pasted together using electrically conductive primer.

The photosensitive member was made using Example 1 of the photosensitive member production method, and the developer was produced using the Example 1 of the developer production method. The image evaluation was made in the same manner as Embodiment 5, except that the voltage of the power source 612 was +1,000 V; a power source 614 provided a voltage comprising a DC component having a voltage of −500 V, and an AC component being superposed thereon and having a peak-to-peak voltage of 2,500 V; and the development bias was a DC current with a voltage of 300 V. Further, the dark portion potential was −500 V, and the light portion potential was −100 V. The post-transfer potential of the photosensitive member was −50 V after the precharge exposure. The results of the evaluations are given in Table 3.

When the fixed brush 411 was used to charge the photosensitive member made using Example 2 of the photosensitive member production method, the discharge inception voltage was 500 V, whereas when the plate-like member was employed to charge the photosensitive member made using Example 2 of the photosensitive member production method, the discharge inception voltage was 950 V.

Further, more tests were conducted by varying the voltage applied to the fixed brush to +800 V, +600 V, and +550 V, all of which produced preferable images.

As regards all of the embodiments described above, in order to reduce the amount of the post transfer residual toner, the contact angle of the photosensitive member surface relative to water should be no less than 85°, preferably, no less than 90°.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

developing-cleaning means for cleaning said image bearing member by removing residual toner from said image bearing member simultaneously with formation of a toner image by developing an electrostatic latent image formed on said image bearing member with toner having a charging polarity opposite from a charge polarity of the electrostatic latent image;

transfer means for transferring the toner image from said image bearing member to a transfer material; and charging means for charging the toner remaining on said image bearing member after image transfer by said transfer means and before development by said developing-cleaning means to a polarity which is the same as the charging polarity of the toner image, and for charging said image bearing member to a polarity which is opposite from the charging polarity of the toner image.

2. An apparatus according to claim 1, wherein said charging means includes a first charging means for charging said image bearing member after the image transfer to a polarity opposite from the charging polarity of the toner image, and second charging means for charging the remaining toner to the same polarity as that of the charging polarity of the toner image without changing a polarity of a potential of said image bearing member after charging operation of said first charging means and before developing operation of said developing-cleaning means.

3. An apparatus according to claim 2, wherein said image bearing member includes a photosensitive member, and said apparatus further comprises exposure means for exposing said photosensitive member to image light to for the electrostatic latent image, and charging operation is carried out by said second charging means after operation of said first charging means but before the exposure of said exposure means.

4. An apparatus according to claim 2 or 3, wherein said second charging means includes a charging member contacted or proximate to said image bearing member.

5. An apparatus according to claim 4, wherein a potential Vd(V) of said image bearing member before charging of said second charging means but after charging by said first charging means, and a potential Vc(V) applied to said charging member, and a charge starting voltage of said image bearing member by said charging member Vth(V), satisfy:

$$|Vd-Vc|>|Vth| \text{ and } |Vd|>|Vc|.$$

6. An apparatus according to claim 5, wherein the following is satisfied:

$$|Vc-Vth|\geqq 50.$$

7. An apparatus according to claim 5, wherein said charging member is electrically grounded.

8. An apparatus according to claim 1, wherein said charging means includes a first charging means for charging said remaining toner after the image transfer to a polarity the same as the charging polarity of the toner image, and second charging means for charging said image bearing member to the polarity opposite from that of the charging polarity of the toner image without changing a polarity of a potential of remaining toner after charging operation of said first charging means and before developing operation of said developing-cleaning means.

9. An apparatus according to claim 8, wherein said image bearing member includes a photosensitive member, and said apparatus further comprises exposure means for exposing said photosensitive member to image light to for the electrostatic latent image, and charging operation is carried out by said second charging means after operation of said first charging means but before the exposure of said exposure means.

10. An apparatus according to claim 8 or 9, wherein said second charging means includes a charging member contacted or proximate to said image bearing member, and the charging member is supplied with an oscillating voltage.

11. An apparatus according to claim 10, wherein said oscillating voltage has a peak-to-peak voltage which is larger than twice as large as a charging starting voltage of said image bearing member by said charging member.

12. An apparatus according to claim 11, wherein said oscillating voltage is a DC voltage biased with an AC voltage.

13. An apparatus according to claim 1, wherein a contact angle of a surface of said image bearing member relative to water is not less than 85 decrees.

14. An apparatus according to claim 13, wherein a surface of said image bearing member contains lubricant powder comprising fluorine.

15. An apparatus according to claim 1, wherein said developing-cleaning means contains a developer containing inorganic powder.

16. An apparatus according to claim 1, wherein said image bearing member has an electrophotographic photosensitive member.

* * * * *

UNITED STATES PATENT AND TRADEMARK OFFICE

CERTIFICATE OF CORRECTION

PATENT NO. : 5,751,405

DATED : May 12, 1998

INVENTOR(S) : SHUICHI AITA ET AL.

It is certified that error appears in the above-identified patent and that said Letters Patent is hereby corrected as shown below:

COLUMN 3:

Line 19, "charge" should read --charged--.

COLUMN 11:

Line 67, "Thickness:" should read --thickness:-.

COLUMN 12:

Line 33, "an" should read --a--.

COLUMN 13:

Line 5, "in. the" should read --in the--.
Line 11, "designate" should read --designates--.
Line 35, "-500V)" should read -- -550V)--.

COLUMN 16:

Line 48, "Embodiment'" should read --Embodiment 3--.

COLUMN 18:

Line 65, "shows" should read --show--.

COLUMN 21:

Line 8, "electrically" should read --electrical--.

UNITED STATES PATENT AND TRADEMARK OFFICE

CERTIFICATE OF CORRECTION

PATENT NO. : 5,751,405

DATED : May 12, 1998

INVENTOR(S) : SHUICHI AITA ET AL.

It is certified that error appears in the above-identified patent and that said Letters Patent is hereby corrected as shown below:

COLUMN 23:

Line 31, "not" should read --did not-.

COLUMN 24:

Line 55, "past transfer" should read --post transfer--.

COLUMN 25:

Line 11, "light to for" should read --light to form--.

COLUMN 26:

Line 10, "light to for" should read --light to form--.
Line 28, "decrees." should read --degress.-.

Signed and Sealed this

Twenty-third Day of February, 1999

*Attest:*

Q. TODD DICKINSON

*Attesting Officer*

*Acting Commissioner of Patents and Trademarks*